US007013097B2

(12) United States Patent
Akizuki et al.

(10) Patent No.: US 7,013,097 B2
(45) Date of Patent: Mar. 14, 2006

(54) FIXING APPARATUS, AND IMAGE FORMING APPARATUS

(75) Inventors: Tomoo Akizuki, Shizuoka (JP); Masao Umezawa, Shizuoka (JP); Toru Saito, Shizuoka (JP); Toshikazu Tsuchiya, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 142 days.

(21) Appl. No.: 10/720,215

(22) Filed: Nov. 25, 2003

(65) Prior Publication Data

US 2004/0105693 A1 Jun. 3, 2004

(30) Foreign Application Priority Data

Nov. 29, 2002 (JP) ..... 2002-348474

(51) Int. Cl.
*G03G 15/20* (2006.01)

(52) U.S. Cl. ..... 399/69; 399/328

(58) Field of Classification Search ..... 219/216; 399/67–70, 320, 328, 335, 337, 38
See application file for complete search history.

(56) References Cited

U.S. PATENT DOCUMENTS

| | | | | |
|---|---|---|---|---|
| 5,420,679 | A | 5/1995 | Goto et al. | 399/335 |
| 5,745,833 | A | 4/1998 | Abe et al. | 399/330 |
| 5,899,599 | A * | 5/1999 | Kato | 399/69 |
| 6,049,691 | A | 4/2000 | Abe et al. | 399/330 |
| 6,347,201 | B1 | 2/2002 | Sano et al. | 399/67 |
| 6,383,628 | B1 | 5/2002 | Abe et al. | 428/334 |
| 6,430,386 | B1 | 8/2002 | Okubo et al. | 399/328 |
| 6,519,426 | B1 * | 2/2003 | Goto et al. | 399/69 |
| 6,556,806 | B1 | 4/2003 | Tsuruya et al. | 399/322 |
| 2002/0012543 | A1 * | 1/2002 | Nakamura et al. | 399/69 |
| 2003/0039480 | A1 * | 2/2003 | Omoto et al. | 399/69 |

FOREIGN PATENT DOCUMENTS

| | | |
|---|---|---|
| JP | 11-15303 | 1/1999 |

* cited by examiner

*Primary Examiner*—Hoan Tran
(74) *Attorney, Agent, or Firm*—Fitzpatrick, Cella, Harper & Scinto

(57) ABSTRACT

Disclosed is a fixing apparatus which includes a first rotatable member having an endless configuration, a second rotatable member in pressure contact with the first rotatable member which causes a recording material bearing an image to be nipped and conveyed at a pressure contact portion between the first and second rotatable members, a temperature raising unit for raising temperature of a local portion of the first rotatable member by reception of electric power supply, a temperature detecting unit for detecting temperature of a location different from the pressure contact portion with respect to a rotational direction of the first rotatable member, a first control unit for feedback-controlling electric power to be supplied to the temperature raising unit based on the temperature detected by the temperature detecting unit, a setting unit for variably setting a set value corresponding to electric power to be supplied to the temperature raising unit, based on a temperature rise speed detected by the temperature detecting unit when a predetermined amount of electric power is supplied, and a second control unit for temporally supplying electric power corresponding to the set value set by the setting unit to the temperature raising unit in timing close to timing in which the temperature detected by the temperature detecting unit reaches a target temperature, or timing close to timing in which the recording material rushes in the pressure contact portion when the fixing apparatus is started up.

12 Claims, 19 Drawing Sheets

CHANGE OF MAIN/SUB THERMISTOR READ VALUES IN EACH MAXIMUM SUPPLY POWER

FIXING APPARATUS, AND IMAGE FORMING APPARATUS

BACKGROUND OF THE INVENTION

1. Field of the Invention

The present invention relates to a fixing apparatus and an image forming apparatus, and particularly to image forming apparatuses, such as electrophotographic copying machines, printers, and facsimile apparatuses, and fixing apparatuses usable therein.

2. Related Background Art

In recent years, coloring has been advancing in image forming apparatuses, such as copying machines and printers. In connection with an electrophotographic color image forming apparatus, a so-called in-line image forming apparatus has been proposed in which an array of photosensitive drums are arranged corresponding to respective colors, and toner images of respective colors formed on the respective photosensitive drums are sequentially superimposed on a transferring medium such that a color image can be formed.

As a fixing apparatus to be used in such a color image forming apparatus, a thermal roller fixing apparatus with a fixing member having an elastic layer is well known. In such a thermal roller fixing system using the elastic layer, there is posed a problem that thermal capacity of the thermal roller itself tends to be large, and it likely takes a long time (warm-up time) to heat the fixing roller up to temperature suitable for fixation of a toner image. This problem causes a user to wait for start-up of the apparatus for an unnecessarily long time, and is also undesirable in the light of consumption of electric power. Further, cost of the fixing apparatus is liable to increase.

As a fixing apparatus capable of achieving a short warm-up time, a fixing apparatus of a belt fixing type is well known. This type is often used in a monochromatic (black and white) printer. FIG. 14 schematically illustrates the structure of a model of such a belt fixing apparatus.

In FIG. 14, reference numeral 201 designates an entire structure of the belt fixing apparatus. Reference numeral 202 designates a fixing belt unit which is an assembly including a trough-shaped heater holder 207 having an approximately semicircular arcuate cross section, a fixing heater fixed to a lower surface of the heater holder 207 along its extension direction (a direction perpendicular to a sheet of FIG. 14), a thin fixing belt 203 of an endless belt configuration (a cylindrical shape) externally wound loosely around the heater holder 207 with the fixing heater 204, and so forth.

Reference numeral 205 designates an elastic pressure roller which is arranged with opposite ends of its metal core being freely rotatably supported by side plates of the fixing apparatus.

The fixing belt unit 202 is disposed above and parallel to the elastic pressure roller 205 with a side of the fixing heater 204 facing downward. And, the heater holder 207 is pressed downward with predetermined pressure created by a biasing unit (not shown) which acts on opposite ends of the heater holder 207. Accordingly, the lower surface of the fixing heater 204 is brought into pressure contact with the upper surface of the elastic pressure roller 205 against its elasticity with the fixing belt 203 being sandwiched therebetween. A fixing nip portion 206 with a predetermined width is thus formed.

The elastic pressure roller 205 is driven and rotated at a predetermined circumferential rate in a counterclockwise direction of an arrow by a driving mechanism (not shown). Due to the rotational driving of the elastic pressure roller

205, friction force between the elastic pressure roller 205 and the fixing belt 203 occurs at the fixing nip portion 206, and hence rotational force acts on the fixing belt 203. The fixing belt 203 is accordingly rotated around the outer surface of the heater holder 207 in a clockwise direction of an arrow at a circumferential speed approximately corresponding to the circumferential speed of the elastic pressure roller 205, while the inner surface of the fixing belt 203 is in close contact with and is slid on the lower surface of the fixing heater 204 at the fixing nip portion 206.

The fixing belt 203 is an endless belt of heat resisting resin with a thickness of about 50 microns, for example. A separating layer (fluorine coating resin, or the like) with a thickness of 10 microns is formed on the surface of the heat resisting resin. Further, no elastic layer is used in the fixing belt 203 to decrease its thermal capacity.

The fixing heater 204 is a ceramic substrate with a resistance heating body formed thereon. A temperature detecting unit 209 is disposed in contact with the fixing heater 204 such that temperature of the fixing heater 204 can be detected. Electric power supply to the fixing heater 204 is controlled by a control unit (not shown) such that its temperature can be controlled and reach a desired temperature.

Under a condition under which the elastic pressure roller 205 is driven and rotated, the fixing belt 203 is accordingly rotated, and the fixing heater 204 is heated up and adjusted to a predetermined temperature, a recording material P bearing unfixed toner images t is guided into the fixing nip portion 206 between the fixing belt 203 and the elastic pressure roller 205. An unfixed toner image bearing surface of the recording material P is brought into close contact with the outer surface of the fixing belt 203, and the recording material P is nipped at and conveyed through the fixing nip portion 206 simultaneously with the rotation of the fixing belt 203. During the nipped conveyance of the recording material P, heat of the fixing heater 204 is transmitted to the recording material P through the fixing belt 203, and the recording material P is subjected to pressure of the fixing nip portion 206. The unfixed toner image t is thus fixed on the recording material P as a permanent fixed image by those heat and pressure. Upon passing of the recording material P through the fixing nip portion 206, the recording material P is self-stripped from the surface of the fixing belt 203 by curvature, and discharged.

In the thus-constructed fixing apparatus 201, thermal capacity of the fixing belt 203 is made so small that the fixing nip portion 206 can be heated to temperature for enabling fixation of the toner image in a short time immediately after supply of electric power to the fixing heater 204.

However, when such a belt fixing apparatus 201 using the fixing belt 203 without the elastic layer is used as the fixing apparatus of the color image forming apparatus, the following situation occurs since no elastic layer is provided on the fixing belt 203 serving as a fixing member. The surface of the fixing belt 203 cannot follow unevenness of the surface of the recording material P, unevenness resulting from presence and absence of the toner layer, and unevenness of the toner layer itself, and hence a difference in heat transmitted from the fixing belt 203 appears between a concave portion and a convex portion on the recording material P. Sufficient heat is transmitted from the fixing belt 203 at the convex portion in close contact with the fixing belt 203, while only less heat is transmitted from the fixing belt 203 at the concave portion in less contact with the fixing belt 203 than at the convex portion. Thus, the toner layer reflects a difference in its melt condition due to the unevenness, and hence the fixed image is likely to be affected.

Particularly, in the color image forming system, toner images of plural colors are superimposed and mixed, so that its unevenness of the toner layer is larger than that in the monochromatic image forming system. Therefore, when no elastic layer is provided on the fixing belt 203, unevenness of gloss of the fixed image increases, and image quality is hence lowered. Further, in the event that the recording material P is an OHP sheet, when the fixed image is projected, light scattering occurs due to microscopic unevenness of the surface of the fixed image, and permeability is resultantly lowered.

Further, in the event that the fixing belt 203 is coated with silicone oil or the like such that sufficient heat can be fully transmitted to the fixing belt 203 without the elastic layer, the recording material P, and the uneven portion of the unfixed toner image t, the cost is likely to increase, and the fixed image and the recording material P are liable to be sticky due to the oil.

In such a situation, an inexpensive color on-demand fixing apparatus using a fixing belt with an elastic layer as the belt fixing apparatus has been proposed (see Japanese Patent Application Laid-Open No. H11-15303, for example).

FIG. 15 schematically illustrates the structure of the belt fixing apparatus using a fixing belt 203 with an elastic layer as the fixing member. In FIG. 15, members and portions common to those in FIG. 14 are designated by like reference numerals, and description thereof is omitted.

When this fixing apparatus is used, heat conductivity of a silicone rubber layer used as the elastic layer of the fixing belt 203 is small. Accordingly, temperature response of the fixing belt 203 is poor, and temperature of a sleeve following the temperature of the fixing heater 204 is largely delayed in response. Further, a difference in temperature between the fixing heater 204 and the fixing belt 203 is very large, say several tens degrees (° C.), even in a stationary state, and the temperature difference largely varies between idling rotation time and sheet passing time. Accordingly, it is very difficult to control the temperature of the fixing belt.

Therefore, a temperature controlling method as illustrated in FIG. 15 is proposed in place of the method using the fixing heater portion as in the apparatus illustrated in FIG. 14. In the temperature controlling method of FIG. 15, a temperature detecting unit 209 is provided on the surface or inner surface of the fixing belt 203 to detect the temperature of the fixing belt 203 itself, and the temperature of the fixing heater 204 is controlled by feedback control, such as PID control (Proportional-Integral-Differential), such that the temperature of the fixing belt can be adjusted. When such a construction is used, the temperature of the fixing belt 203 can be controlled more precisely.

This fixing apparatus, however, has the following disadvantages.

1) Heat conductivity of the silicone rubber layer used as the elastic layer of the fixing belt 203 is small, and many members are present in a location from the fixing heater 204 to the surface of the fixing belt. Accordingly, a so-called heat response, i.e., a time speed from the start of supply of electric power to the fixing heater 204 to rise of the temperature, is slow.

2) Location of the temperature detecting unit 209 for detecting the temperature of the fixing belt 203 is away from the fixing nip portion 206, and hence detection timing of the fixing nip portion is likely to be delayed.

Thus, dead time (time lag) is comparatively long for those two reasons. The feedback control represented by the PID control is accomplished by detection of variations in a control amount, and supply of an operation amount corresponding thereto. Therefore, it takes much time for the temperature of the fixing belt 203 to reach an appropriate temperature from the start of supply of electric power subsequent to the detection of variations in the control amount. As a result, overshoot and undershoot are likely to occur, and large hunting (temperature ripple) is likely to appear.

The above problems are especially outstanding (1) immediately after the start-up, and (2) at the time of start of sheet passing. As a method for coping with those problems, it is known that the following methods are very effective.

(1) In a first method, a first electric power level for speedily starting up the temperature of the fixing apparatus and a second electric power level for stabilizing the temperature of the fixing apparatus are prepared at the time of the start-up of the fixing apparatus, and operation is advanced to feedback control after a necessary electric power value set by considering a heat storage condition of the fixing apparatus is supplied for a predetermined time of period.

(2) In a second method, PID control is not executed for a predetermined time of period in synchronization with the rush-in timing of the recording material P at the time of start of the sheet passing, and when electric power to be supplied to the fixing heater 16 is corrected to a predetermined value and then input, the electric power is corrected to an approximately necessary electric power value set by considering the thermal characteristic of the recording material P and the heat storage condition of the fixing apparatus.

When the above-discussed control is executed, it is necessary that the predetermined electric power value of the second power level at the start-up time, and the predetermined power value to be corrected at the time of starting the sheet passing are approximately equal to the electric power value necessary for stabilization of the temperature of the fixing apparatus at a target temperature at the start-up time, and the electric power value needed at the time of sheet passing, respectively. In the event that the predetermined power value is greatly different from the necessary electric power value, temperature is likely to be remote from the target temperature, and hence the temperature ripple is liable to increase.

In the above fixing apparatus, wave-number control or phase control is used as the output control of electric power, in which the electric power is controlled in a manner that the output is determined by a percentage (%) of the maximum supply power (full power), but not in a manner that the output is determined by a value of watt. In other words, it is necessary to control the electric power value needed for control of the temperature by using the percentage (%) of the maximum supply power.

On the other hand, the maximum supply power fluctuates due to variations in input voltage into the fixing heater 204 and resistance value of the fixing heater 204. Table 1 shows variations in voltage, resistance and electric power in this fixing apparatus to be used in a region of 120 V. In this table, the range of the input voltage is 85% to 110% of a rated voltage, and variation in the resistance is ±7%.

TABLE 1

| Variations in voltage, resistance and electric power in this fixing apparatus to be used in a region of 120 V | | | |
|---|---|---|---|
| 120-V region | Lower limit of power | Typical | Upper limit of power |
| Voltage | 102 V | 120 V | 132 V |
| Resistance | 13.91 Ω | 13 Ω | 12.09 Ω |
| Electric power | 747 W | 1,107 W | 1,441 W |

Here, the variation in the maximum supply power to the fixing apparatus 204 ranges from 747 W to 1,441 W, i.e., the maximum value is about twice the minimum value. When the above-discussed control (1) or (2) is executed, a center value of the maximum supply power is 1,107 W, and hence power of 332 W is output where 30% thereof is output as a predetermined electric power. In contrast, the predetermined power is 224 W where the lower power limit of 747 W is used, and the predetermined power is 432 W where the upper power limit of 1,441 W is used. Accordingly, under a condition under which supply of the predetermined power of 332 W is optimum, for example, a large temperature ripple is liable to occur at the time of input of the predetermined power due to the variation in the predetermined electric power accompanying the variation in the above maximum supply power.

Specifically, the temperature ripple becomes about 12° C. at upper and lower limits of the maximum supply power. In an in-line electrophotographic color image forming apparatus used in a test, gloss of an output printed matter fluctuates about seven (7) in monochrome, and the gloss fluctuates about eleven (11) in secondary color. Quality of the image is thus lowered (see Table 2). Further, poor fixation, such as hot offset and degradation of fixing characteristic, is likely to appear accompanying a large fluctuation in temperature, depending on a recording material and an image pattern.

TABLE 2

| Variation in gloss at upper and lower limits of the maximum supply power in a region of 120 V | | |
|---|---|---|
| | Gloss average | Prior art Variation width |
| Monochrome (M/S = 0.55) | | |
| Y | about 13 | about 7 |
| M | about 13 | about 7 |
| C | about 12 | about 7 |
| K | about 9 | about 6 |
| Secondary color (M/S = 1.2) | | |
| R | about 19 | about 11 |
| G | about 18 | about 11 |
| B | about 18 | about 11 |

In the event that the maximum supply power is large, overshoot at the start-up time becomes excessively large. Accordingly, if use is repeated, operations at higher temperatures are repetitively performed, and hence life of the fixing apparatus is liable to be short.

Further, excessive overshoot causes a large loss even in the light of consumption of electric power, and electric power is likely to be unnecessarily consumed wastefully.

Here, the resistance of the fixing heater 204 in the 120-V region is assumed to be 13.0 Ω. In a region where the rated voltage is 127 V, however, when a fixing heater having the same resistance is used, it is necessary to consider that the maximum supply power to the fixing heater 204 can be up to 1,614 W if variation up to 110% and variation in the resistance value are taken into consideration.

Further, when use in a 100-V region is considered, it is necessary to consider that the maximum supply power to the fixing heater 204 can be up to 519 W if variation in the rated voltage up to 85% of 100 V and variation in the resistance value are taken into consideration.

To sum up, the variation in the maximum supply power to the fixing heater 204 ranges from 519 W to 1,614 W, which is about three times larger than 519 W.

In such a case, control of the temperature becomes more unstable for similar reasons. Accordingly, quality of the image is further lowered due to variation in gloss, and worse fixation, such as hot offset and degradation of fixing characteristic, is likely to occur depending on the recording material and the image pattern. Further, when the maximum supply power is large, overshoot at the start-up time becomes larger. Accordingly, if use is repeated, operations at still higher temperatures are repetitively performed, and hence life of the fixing apparatus is liable to be further shortened. In addition, consumption of electric power further increases.

To cope with the above problem, there has been proposed a method in which the resistance value of the fixing heater 204 is selectively set in conformity with the rated voltage in each region. In this case, however, costs of the fixing heater and management increase. Further, if the apparatus is used in a different region other than its destination region, or if the apparatus is erroneously destined to a different region, the above problem occurs, and accordingly there occur a fear that the user becomes unsatisfied, and a fear that expenditure for service resultantly increases.

Here, even when the heater is selectively set for each destination as discussed above, the problem in connection with upper and lower limits of the maximum supply power in each region itself still remains. In other words, a region where an electric power source is considerably unstable exists among regions where the fixing apparatus is used, and a case where a range of input electric power greatly differs from the rated voltage occurs. Also in such a case, similar problem arises consequently.

SUMMARY OF THE INVENTION

In view of the above problem, it is an object of the present invention to solve the following problems by executing an accurate temperature control of a fixing member irrespective of variations in an input voltage and a resistance value of a fixing heater even in the event that a fixing belt with an elastic layer is used as the fixing member.

(1) Provision of a fixing apparatus capable of obtaining a high-quality image without image degradation and unevenness of printing quality, such as gloss, irrespective of variations in the input voltage and the resistance value of the fixing heater, and an image forming apparatus including the image forming apparatus.

(2) Provision of a long life fixing apparatus having high durability regardless of variations in the input voltage and the resistance value of the fixing heater, and an image forming apparatus including the image forming apparatus.

(3) Provision of a fixing apparatus having characteristic of low consumption of electric power irrespective of variations in the input voltage and the resistance value of the fixing heater, and an image forming apparatus including the image forming apparatus.

(4) Achievement of reduction in cost and expenditure for service by providing the same fixing apparatus even in regions of different rated voltages.

According to the present invention, there can be provided the following fixing apparatus.

In this fixing apparatus, there are arranged at least a heating member or heater, a power supply unit for supplying electric power to the heating member, at least a temperature detecting unit, a first rotatable member capable of being moved with a recording material, and a second rotatable member for forming a pressure contact portion together with the first rotatable member, and conveying the recording material; temperature of the first rotatable member is controlled by feedback-controlling electric power to be supplied to the heating member from the power supply unit based on temperature detected by the temperature detecting unit, such that the recording material bearing an image can be nipped and conveyed at the pressure contact portion, and can be heated; electric power to be supplied to the heating member necessary for heating thereof is corrected to a predetermined electric power approximately equal to an electric power value which is needed to stably operate the fixing apparatus; and the electric power supplied to the heating member is controlled based on the maximum supply power value to the fixing apparatus at the time of output of the predetermined electric power.

Accordingly, there can be provided a fixing apparatus in which temperature of the fixing member can be accurately controlled irrespective of variations in the input voltage and the resistance value of the fixing heater, and hence a high-quality image without image degradation and unevenness of printing quality, such as gloss, can be obtained, and long life, high durability and characteristic of low consumption of electric power can be achieved.

As discussed above, according to the present invention, the following advantages can be obtained even when the fixing belt with the elastic layer is used as the fixing member. Temperature of the fixing member can be accurately controlled irrespective of variations in the input voltage and the resistance value of the fixing heater, and hence a high-quality image without image degradation and unevenness of printing quality, such as gloss, can be obtained, long life, high durability and characteristic of low consumption of electric power can be achieved, and reduction in cost and expenditure for service can be achieved by providing the same fixing apparatus even in regions of different rated voltages.

According to the first aspect of the present invention, there is provided a fixing apparatus which includes a first rotatable member having an endless shape; a second rotatable member in pressure contact with the first rotatable member, which causes a recording material bearing an image to be nipped and conveyed at a pressure contact portion between the first and second rotatable members; a temperature raising unit for raising temperature of a local portion of the first rotatable member by reception of electric power supply; a temperature detecting unit for detecting temperature of a location different from the pressure contact portion with respect to a rotational direction of the first rotatable member; a first control unit for feedback-controlling electric power to be supplied to the temperature raising means based on the temperature detected by the temperature detecting unit; a setting unit for variably setting a set value corresponding to electric power to be supplied to the temperature raising unit, based on a temperature rise speed detected by the temperature detecting unit when a predetermined amount of electric power is supplied; and a second control unit for temporally supplying electric power corresponding to the set value set by the setting unit to the temperature raising unit in timing close to timing in which the temperature detected by the temperature detecting unit reaches a target temperature, or timing close to timing in which the recording material rushes in the pressure contact portion when the fixing apparatus is started up.

Accordingly, there can be provided a fixing apparatus in which temperature of the fixing member can be accurately controlled irrespective of variations in the input voltage and the resistance value of the fixing heater (the heating member), and hence a high-quality image without image degradation and unevenness of printing quality, such as gloss, can be obtained, and long life, high durability and characteristic of low consumption of electric power can be achieved.

According to the second aspect of the present invention, there is provided a fixing apparatus according to the first aspect, in which time t of period for which the second control unit is operated is represented by $t \leqq (a+L)/V$ where V is a moving speed of the outer circumference of the first rotatable member, a is a length of the first rotatable member from the pressure contact portion to a temperature detecting location, and L is an outer circumferential length of the first rotatable member.

Accordingly, there can be provided a fixing apparatus in which temperature of the fixing member can be accurately controlled irrespective of variations in the input voltage and the resistance value of the fixing heater (the heating member), and hence a high-quality image without image degradation and unevenness of printing quality, such as gloss, can be obtained, and long life, high durability and characteristic of low consumption of electric power can be achieved.

According to the third aspect of the present invention, there is provided a fixing apparatus according to the first or second aspect, in which the temperature raising unit includes a heater for generating heat by reception of supply of electric power, which is provided close to the pressure contact portion, or a coil for generating magnetic field due to supply of electric power and causing eddy current to occur in the first rotatable member, which is provided close to the pressure contact portion.

Accordingly, the present invention can be applied even to a fixing apparatus having on-demand characteristic, and there can be provided a fixing apparatus in which temperature of the fixing member can be accurately controlled irrespective of variations in the input voltage and the resistance value of the fixing heater (the heating member), and hence a high-quality image without image degradation and unevenness of printing quality, such as gloss, can be obtained, and long life, high durability and characteristic of low consumption of electric power can be achieved.

According to the fourth aspect of the present invention, there is provided a fixing apparatus according to the first or second aspect, which further includes a nonvolatile memory for storing a value corresponding to the temperature rise speed detected by the temperature detecting unit when the predetermined amount of electric power is supplied, and the set value set by the setting unit.

Accordingly, there can be provided a fixing apparatus in which temperature of the fixing member can be accurately controlled irrespective of variations in the input voltage and the resistance value of the fixing heater, and hence a high-quality image without image degradation and unevenness of printing quality, such as gloss, can be obtained, and long life, high durability and characteristic of low consumption of electric power can be achieved. Further, a stable temperature adjustment control can be maintained even prior to and subsequent to Off-On of an electric power source.

According to the fifth aspect of the present invention, there is provided an image forming apparatus in which an image is formed on the recording material, and the image on the recording material is fixed using the fixing apparatus according to the first or second aspect of the present invention.

According to the sixth aspect of the present invention, there is provided a fixing apparatus according to the first or second aspect, which further includes a first judging unit for judging a heat storage condition of the fixing apparatus, and in which the setting unit variably sets the set value corresponding to electric power to be supplied to the temperature raising unit, based on a judgment result obtained by the first judging unit, and the temperature rise speed detected by the temperature detecting unit when the predetermined amount of electric power is supplied.

Accordingly, there can be provided a fixing apparatus in which temperature of the fixing member can be accurately controlled irrespective of variations in the input voltage and the resistance value of the fixing heater, irrespective of the heat storage condition of the fixing apparatus, and even when the recording material rushes in, and hence a high-quality image without image degradation and unevenness of printing quality, such as gloss, can be obtained, and long life, high durability and characteristic of low consumption of electric power can be achieved.

According to the seventh aspect of the present invention, there is provided a fixing apparatus according to the first or second aspect, which further includes a second judging unit for judging the kind of the recording material, and in which the setting unit variably sets the set value corresponding to electric power to be supplied to the temperature raising unit, based on a judgment result obtained by the second judging unit, and the temperature rise speed detected by the temperature detecting unit when the predetermined amount of electric power is supplied.

Accordingly, there can be provided a fixing apparatus in which temperature of the fixing member can be accurately controlled irrespective of variations in the input voltage and the resistance value of the fixing heater, irrespective of the kind of the recording material, and even when the recording material rushes in, and hence a high-quality image without image degradation and unevenness of printing quality, such as gloss, can be obtained, and long life, high durability and characteristic of low consumption of electric power can be achieved.

According to the eighth aspect of the present invention, there is provided a fixing apparatus which includes a first rotatable member having an endless configuration; a second rotatable member in pressure contact with the first rotatable member, which causes a recording material bearing an image to be nipped and conveyed at a pressure contact portion between the first and second rotatable members; a temperature raising unit for raising temperature of a local portion of the first rotatable member by reception of electric power supply; a first temperature detecting unit for detecting temperature of a location different from the pressure contact portion with respect to a rotational direction of the first rotatable member; a second temperature detecting unit provided near the pressure contact portion; a first control unit for feedback-controlling electric power to be supplied to the temperature raising unit based on the temperature detected by the first temperature detecting unit; a setting unit for variably setting a set value corresponding to electric power to be supplied to the temperature raising unit, based on a temperature rise speed detected by the second temperature detecting unit when a predetermined amount of electric power is supplied; and a second control unit for temporally supplying electric power corresponding to the set value set by the setting unit to the temperature raising unit in timing close to timing in which the temperature detected by the temperature detecting unit reaches a target temperature, or timing close to timing in which the recording material rushes in the pressure contact portion when the fixing apparatus is started up.

Accordingly, there can be provided a fixing apparatus in which temperature of the fixing member can be accurately controlled irrespective of variations in the input voltage and the resistance value of the fixing heater, irrespective of the recording material, and even when the recording material rushes in, and hence a high-quality image without image degradation and unevenness of printing quality, such as gloss, can be obtained, and long life, high durability and characteristic of low consumption of electric power can be achieved.

According to the ninth aspect of the present invention, there is provided a fixing apparatus according to the eighth aspect, in which time t of period for which the second control unit is operated is represented by $t \leqq (a+L)/V$ where V is a moving speed of the outer circumference of the first rotatable member, a is a length of the first rotatable member from the pressure contact portion to a temperature detecting location, and L is an outer circumferential length of the first rotatable member.

Accordingly, there can be provided a fixing apparatus in which temperature of the fixing member can be further accurately controlled irrespective of variations in the input voltage and the resistance value of the fixing heater (the heating member), and hence a high-quality image without image degradation and unevenness of printing quality, such as gloss, can be obtained, and long life, high durability and characteristic of low consumption of electric power can be achieved.

According to the tenth aspect of the present invention, there is provided a fixing apparatus according to the eighth or ninth aspect, in which the temperature raising unit includes a heater for generating heat by reception of supply of electric power, which is provided close to the pressure contact portion, or a coil for generating magnetic field due to supply of electric power and causing eddy current to occur in the first rotatable member, which is provided close to the pressure contact portion.

Accordingly, the present invention can be applied even to a fixing apparatus having on-demand characteristic, and there can be provided a fixing apparatus in which temperature of the fixing member can be accurately controlled irrespective of variations in the input voltage and the resistance value of the fixing heater (the heating member), and hence a high-quality image without image degradation and unevenness of printing quality, such as gloss, can be obtained, and long life, high durability and characteristic of low consumption of electric power can be achieved.

According to the eleventh aspect of the present invention, there is provided a fixing apparatus according to the eighth or ninth aspect, which further includes a nonvolatile memory for storing the set value set by the setting unit.

Accordingly, there can be provided a fixing apparatus in which temperature of the fixing member can be accurately controlled irrespective of variations in the input voltage and the resistance value of the fixing heater, and hence a high-quality image without image degradation and unevenness of printing quality, such as gloss, can be obtained, and long life, high durability and characteristic of low consumption of electric power can be achieved. Further, a stable temperature adjustment control can be maintained even prior to and subsequent to Off-On of an electric power source.

According to the twelfth aspect of the present invention, there is provided an image forming apparatus in which an image is formed on a recording material, and the image on the recording material is fixed using the fixing apparatus according to the eighth or ninth aspect of the present invention.

According to the thirteenth aspect of the present invention, there is provided a fixing apparatus according to the eighth or ninth aspect, which further includes a first judging unit for judging a heat storage condition of the fixing apparatus, and in which the setting unit variably sets the set value corresponding to electric power to be supplied to the temperature raising unit, based on a judgment result obtained by the first judging unit, and the temperature rise speed detected by the temperature detecting unit when the predetermined amount of electric power is supplied.

Accordingly, there can be provided a fixing apparatus in which temperature of the fixing member can be accurately controlled irrespective of variations in the input voltage and the resistance value of the fixing heater, irrespective of the heat storage condition of the fixing apparatus, and even when the recording material rushes in, and: hence a high-quality image without image degradation and unevenness of printing quality, such as gloss, can be obtained, and long life, high durability and characteristic of low consumption of electric power can be achieved.

According to the fourteenth aspect of the present invention, there is provided a fixing apparatus according to the eighth or ninth aspect, which further includes a second judging unit for judging the kind of the recording material, and in which the setting unit variably sets the set value corresponding to electric power to be supplied to the temperature raising unit, based on a judgment result obtained by the second judging unit, and the temperature rise speed detected by the temperature detecting unit when the predetermined amount of electric power is supplied.

Accordingly, there can be provided a fixing apparatus in which temperature of the fixing member can be accurately controlled irrespective of variations in the input voltage and the resistance value of the fixing heater, irrespective of the kind of the recording material, and even when the recording material rushes in, and hence a high-quality image without image degradation and unevenness of printing quality, such as gloss, can be obtained, and long life, high durability and characteristic of low consumption of electric power can be achieved.

These and further aspects and features of the invention will become apparent from the following detailed description of preferred embodiments thereof in conjunction with the accompanying drawings.

DESCRIPTION OF THE PREFERRED EMBODIMENTS

Preferred embodiments of the present invention will hereinafter be described with reference to the drawings. In those embodiments, sizes, materials, shapes, relative positional relationships, and so forth of their constituent members or portions are not limited to those described therein. They should be appropriately modified according to structures of apparatuses to which the present invention is applied, and various conditions, and the scope of the present invention should no be limited to the embodiments described below.

(First Embodiment)

(1) An Example of an Image Forming Apparatus

Figure 1:
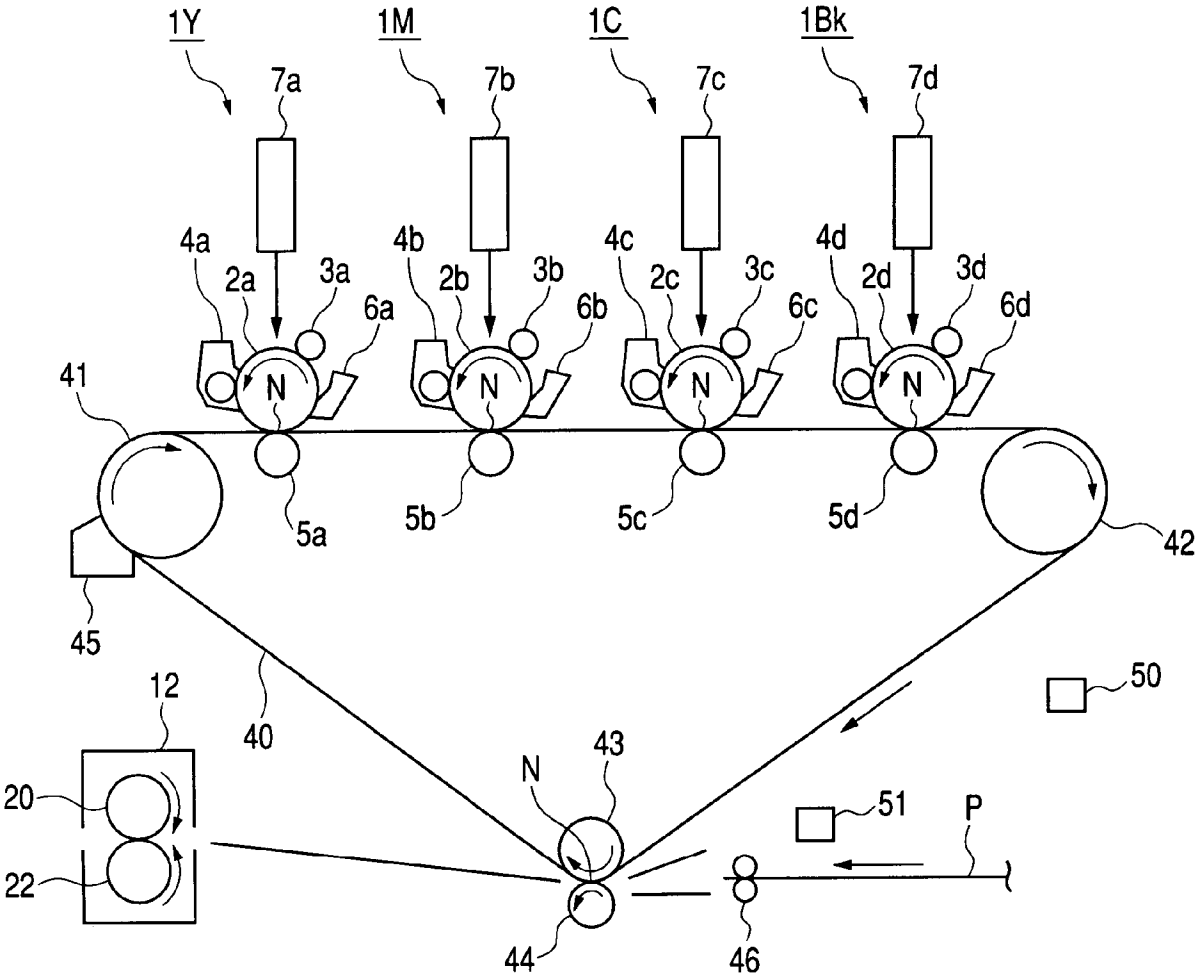
FIG. 1 is a view schematically illustrating the structure of a color image forming apparatus in an embodiment according to the present invention.

FIG. 1 schematically illustrates the structure of a color image forming apparatus of a first embodiment according to the present invention. This image forming apparatus is an electrophotographic full-color printer of a tandem type.

The image forming apparatus is provided with four image forming portions (image forming units) of an image forming portion 1Y for forming a yellow-color image, an image forming portion 1M for forming a magenta-color image, an image forming portion 1C for forming a cyan-color image, and an image forming portion 1Bk for forming a black-color image, and those four image forming portions are arranged in an array with constant intervals.

In the image forming portions 1Y, 1M, 1C and 1Bk, photosensitive drums 2*a*, 2*b*, 2*c* and 2*d* are disposed, respectively. Around the photosensitive drums 2*a*, 2*b*, 2*c* and 2*d*, electrifying rollers 3*a*, 3*b*, 3*c* and 3*d*, developing apparatuses 4*a*, 4*b*, 4*c* and 4*d*, transferring rollers 5*a*, 5*b*, 5*c* and 5*d*, and drum cleaning apparatuses 6*a*, 6*b*, 6*c* and 6*d* are disposed, respectively. Exposing apparatuses 7*a*, 7*b*, 7*c* and 7*d* are provided above places between the electrifying rollers 3*a*, 3*b*, 3*c* and 3*d*, and the developing apparatuses 4*a*, 4*b*, 4*c* and 4*d*, respectively. Yellow toner, magenta toner, cyan toner and black toner are contained in the developing apparatuses 4*a*, 4*b*, 4*c* and 4*d*, respectively.

An intermediate transferring member 40 of an endless belt configuration serving as a transferring medium is in contact with primary transferring portions N of the photosensitive drums 2*a*, 2*b*, 2*c* and 2*d* in the respective image forming portions 1Y, 1M, 1C and 1Bk. The intermediate transferring member 40 extends around a driving roller 41, a supporting roller 42, and a secondary transferring opposing roller 43, and is rotated (moved) by the driving roller 41 in a direction of an arrow (a clockwise direction).

The transferring rollers 5*a*, 5*b*, 5*c* and 5*d* for the primary transfer are in contact with the photosensitive drums 2*a*, 2*b*, 2*c* and 2*d* through the intermediate transferring member 40 at the primary transferring nip portions N, respectively.

The secondary transferring opposing roller 43 is in contact with a secondary transferring roller 44 through the intermediate transferring belt 40, and a secondary transferring portion M is thus formed. The secondary transferring roller 44 is disposed attachable to and detachable from the intermediate transferring belt 40.

Near the driving roller 41 outside the intermediate transferring member 40, a belt cleaning apparatus 45 is disposed for removing and collecting residual toner remaining on the surface of the intermediate transferring member 40.

Further, a fixing apparatus 12 is arranged downstream of the secondary transferring portion M in a conveyance direction of a recording medium P. An environment sensor 50 and a media sensor 51 are further provided in the image forming apparatus.

In this embodiment, upon generation of an image forming operation start signal (a print start signal), the photosensitive drums 2*a*, 2*b*, 2*c* and 2*d* in the image forming portions 1Y, 1M, 1C and 1Bk rotated at predetermined process speeds are uniformly electrified to a negative polarity by the electrifying rollers 3*a*, 3*b*, 3*c* and 3*d*, respectively.

The exposing apparatuses 7*a*, 7*b*, 7*c* and 7*d* convert input color-separated image signals into optical signals at laser output portions (not shown), and scan and expose the electrified photosensitive drums 2*a*, 2*b*, 2*c* and 2*d* with laser light of the converted optical signals to form latent images thereon, respectively.

Initially, yellow toner is electrostatically adsorbed to the photosensitive drum 2*a* with the electrostatic latent image formed thereon in accordance with electrified potential on the drum surface by the developing apparatus 4*a* to which a developing bias of the same polarity as the electrified polarity (negative polarity) of the photosensitive drum 2*a* is applied. The electrostatic latent image is thus visualized, and a developed image is formed. This yellow toner image is primarily transferred onto the rotating intermediate transferring belt 40 at the primary transferring portion N by the transferring roller 5*a* to which a primary transferring bias (its polarity (a positive polarity) is opposite to that of the toner) is applied. The intermediate transferring belt 40 with the yellow toner image transferred thereto is rotated to a side of the image forming portion 1M.

Also in the image forming portion 1M, a magenta toner image formed on the photosensitive drum 2*b* is similarly transferred at the primary transferring portion N with being superimposed on the yellow toner image on the intermediate transferring belt 40.

Further, cyan and black toner images formed on the photosensitive drums 2*a* and 2*d* in the image forming portions 1C and 1Bk are similarly sequentially superimposed on the yellow and magenta toner images transferred on the intermediate transferring belt 40 at the primary transferring portions N, respectively. A full-color toner image is thus formed on the intermediate transferring belt 40.

Then, the recording material (transferring material) P is conveyed to the secondary transferring portion M by a registration roller 46 in synchronization with timing in which a leading end of the full-color toner image on the intermediate transferring belt 40 is moved to the secondary transferring portion M. The full-color toner image is collectively secondarily transferred onto the recording material P by the secondary transferring roller 44 to which a secondary transferring bias (its polarity (a positive polarity) is opposite to that of the toner) is applied. The recording material P with the full-color toner image formed thereon is conveyed to the fixing apparatus 12, and the full-color toner image is heated and pressed by the fixing nip portion between the fixing belt 20 and the pressure roller 22. The toner image is thus melt and fixed on the surface of the recording material P, and the recording material P is discharged outside. An output image of the image forming apparatus is thus produced, and a series of image forming operations are finished.

As described above, the environment sensor 50 is provided in the image forming apparatus, and electrification, development, primary and secondary transferring biases, and fixing condition can be changed in response to atmospheric environment (temperature and humidity) in the image forming apparatus. The sensor 50 is used for adjustment of density of the toner image formed on the recording material P, and achievement of optimum transferring and fixing condition. Further, the media sensor 51 is provided in the image forming apparatus, and transferring bias and fixing condition can be changed in accordance with the kind or quality of the recording material P sensed by the media sensor 51. The sensor 51 is thus used for achievement of optimum transferring on the recording material P and optimum fixing condition.

In the above-discussed primary transferring time, residual primary transferring toners remaining on the photosensitive drums 2*a*, 2*b*, 2*c* and 2*d* are removed and collected by the drum cleaning apparatuses 6*a*, 6*b*, 6*c* and 6*d*, respectively. Further, residual secondary transferring toner remaining on the intermediate transferring belt 40 subsequent to the secondary transferring is removed and collected by the belt cleaning apparatus 45.

(2) Fixing Apparatus 12

Figure 2:
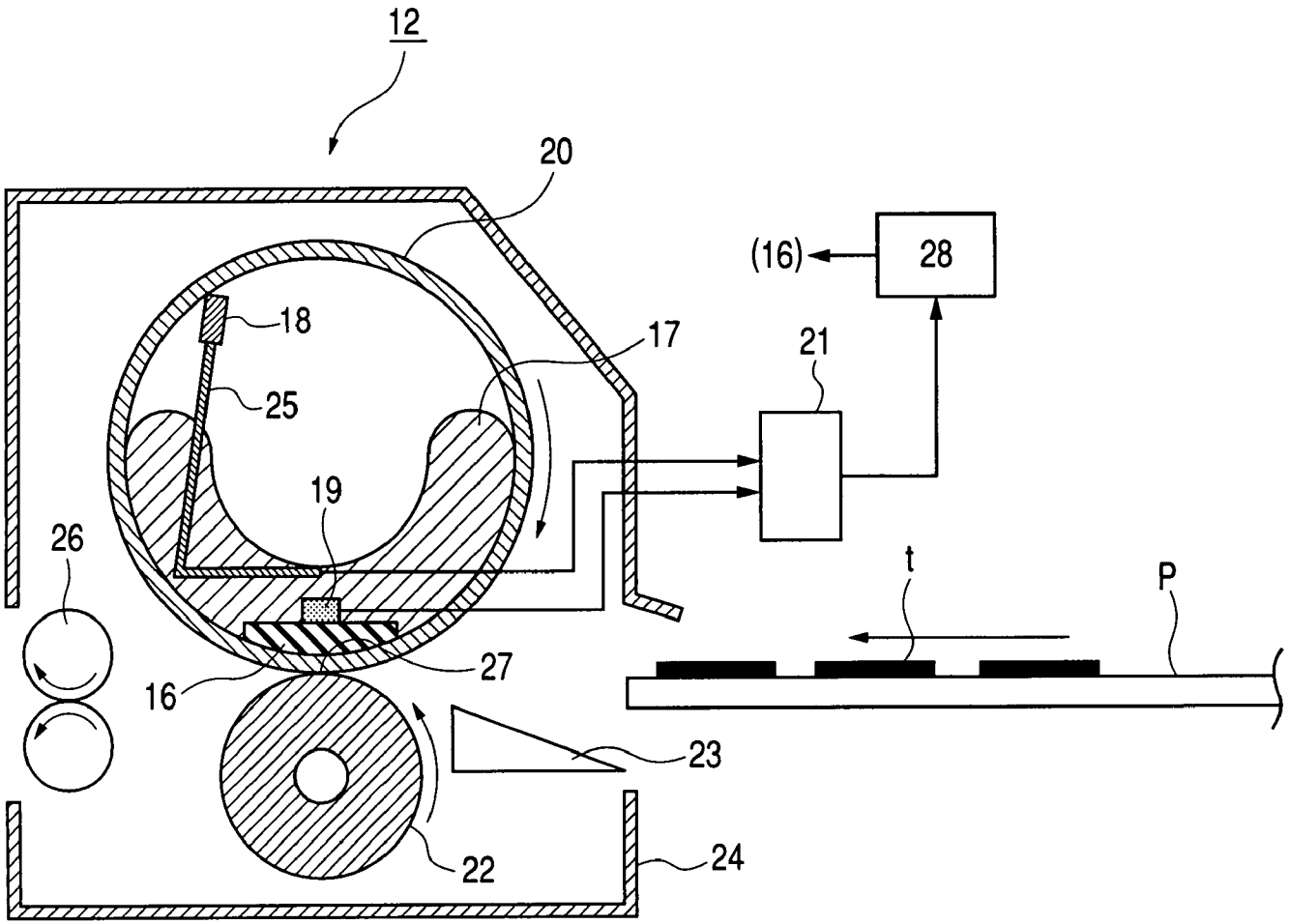
FIG. 2 is a cross-sectional view schematically illustrating the structure of a fixing apparatus in a first or second embodiment according to the present invention.

FIG. 2 schematically illustrates the structure of the fixing apparatus 12. This fixing apparatus 12 is a heating apparatus of a fixing belt heating system and a rotatable pressure member driving system (tensionless type).

1) Entire Structure of the Apparatus 12

Reference numeral 20 designates a fixing belt serving as a first rotatable member (a first fixing member), and the fixing belt 20 is a cylindrical (an endless belt shape, or sleeve shape) member on which an elastic layer is provided. The fixing belt 20 will be described later in 3) in detail.

Reference numeral 22 designates a pressure roller serving as a second rotatable member (a second fixing member). Reference numeral 17 designates a trough-shaped heat-resisting rigid heater holder having an approximately semi-circular arcuate cross section, which serves as a heater holding member. Reference numeral 16 designates a fixing heater serving as a heating member (a heat source), which is mounted to a lower surface of the heater holder 17 along its longitudinal extending direction. The fixing belt 20 is externally wound loosely around the heater holder 17. In this embodiment, the fixing heater 16 is a ceramic heater as described later in 2) in detail.

The heater holder 17 is formed of highly heat-resisting liquid crystal polymer resin, holds the fixing heater 16, and serves as a guide for the fixing belt 20. In this embodiment, ZENITE 7755 (name of product by Dupont) is used as the liquid crystal polymer. The maximum usable temperature of ZENITE is about 270° C.

In the pressure roller 22, a silicone rubber layer having a thickness of about 3 mm is formed on a stainless metal core by injection molding, and the silicone rubber layer is covered with a PFA resin tube having a thickness of about 40 microns. Opposite end portions of the metal core of the pressure roller 22 are supported in a freely rotatable manner by bearings between both opposite side plates (not shown) of a frame 24 of the apparatus.

The fixing belt unit including the heater 16, the heater holder 17, and the fixing belt 20 is disposed above and parallel to the pressure roller 22 with the side of the heater 16 being located on a lower side. The heater holder 17 is biased downward toward the rotational axis of the pressure roller 22 by a predetermined pressing force (98 N on one side, and total pressure of 196 N) of a pressure applying mechanism (not shown) acting on opposite ends of the heater holder 17. Accordingly, the downward facing surface of the fixing heater 16 is brought into pressure contact with the elastic layer of the pressure roller 22 through the fixing belt 20 against elasticity of the elastic layer of the pressure roller 22 by a predetermined pressing force. The fixing nip portion 27 with a predetermined width needed for heating and fixing is thus formed. The pressure applying mechanism includes a pressure releasing mechanism such that the pressure can be released at the time of jam treatment and the like to facilitate removal of the recording material P.

Reference numerals 18 and 19 designate main and sub thermistors serving as first and second temperature detecting units, respectively. The main thermistor 18 serving as the first temperature detecting unit is disposed in non-contact with the fixing heater 16 serving as the heating member, and is in elastic contact with the inner surface of the fixing belt 20 above the heater holder 17 in this embodiment. The main thermistor 18 thus detects temperature of the inner surface of the fixing belt 20. The sub thermistor 19 serving as the second temperature detecting unit is disposed nearer the fixing heater 16 serving as the heating member than the main thermistor 18 is, and is in contact with the rear surface of the fixing heater 16 in this embodiment. The sub thermistor 19 thus detects temperature of the rear surface of the fixing heater 16.

In the main thermistor 18, a thermistor element is mounted to a tip end of a stainless arm 25 fixedly supported by the heater holder 17. Accordingly, even under a condition under which motion of the inner surface of the fixing belt 20 becomes unstable, the thermistor element is always maintained in contact with the inner surface of the fixing belt 20 due to elastic swing of the arm 25.

Figure 3:
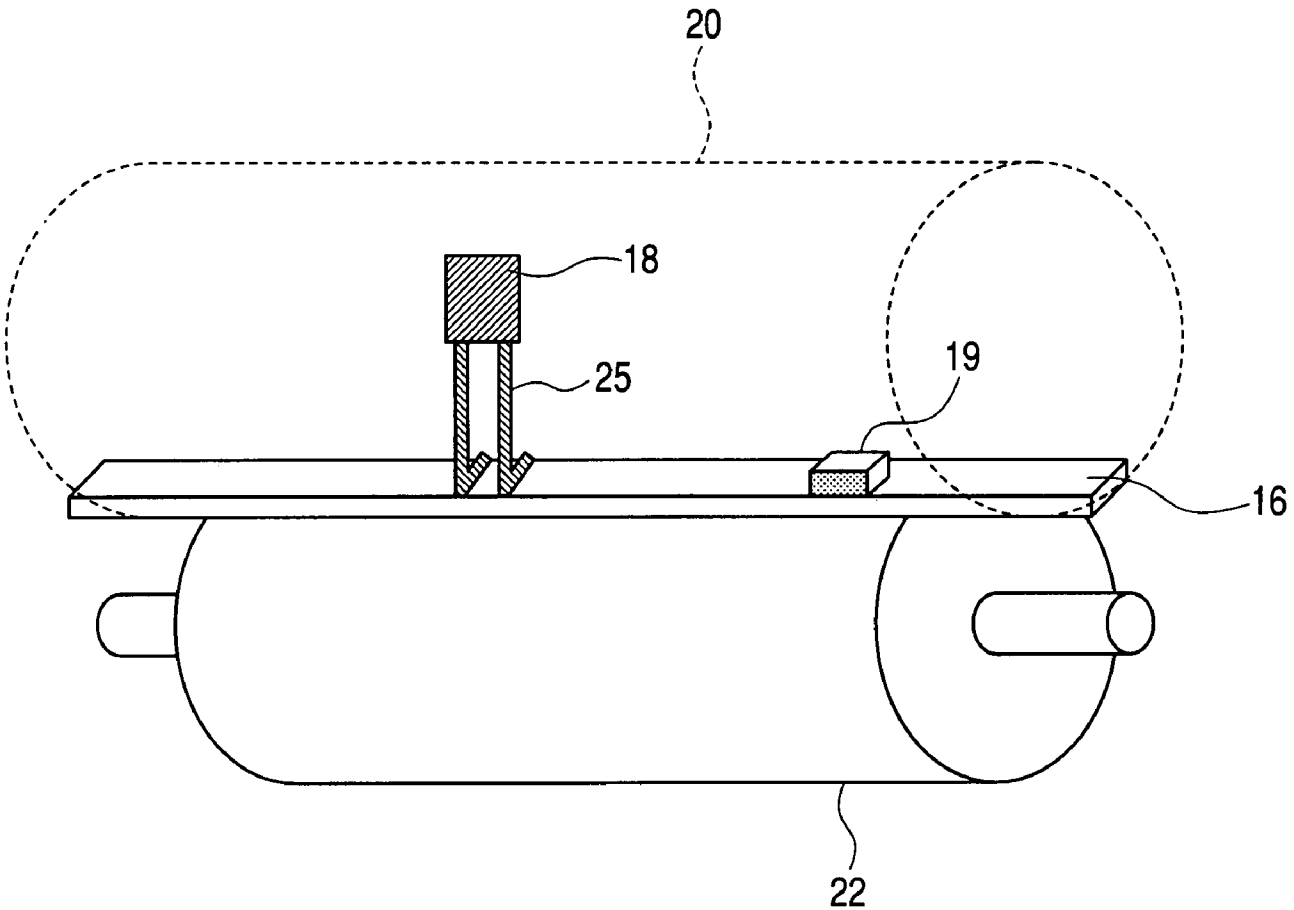
FIG. 3 is a perspective view schematically illustrating the positional relationship between a fixing heater, a main thermistor and a sub thermistor in a first, second or third embodiment according to the present invention.

FIG. 3 illustrates the positional relationship between the fixing heater 16, the main thermistor 18 and the sub thermistor 19 of the fixing apparatus of this embodiment. The main thermistor 18 is disposed near a longitudinal center of the fixing belt 20, while the sub thermistor 19 is diposed near the end of the fixing heater 16. Those main and sub thermistors 18 and 19 are in contact with the inner surface of the fixing belt 20 and the rear surface of the fixing heater 16, respectively.

The main thermistor 18 and the sub thermistor 19 are connected to a control circuit portion (CPU) 21, and the control circuit portion 21 determines contents of temperature adjustment control of the fixing heater 16 based on outputs of the main thermistor 18 and the sub thermistor 19. The control circuit portion 21 thus controls power supply to the fixing heater 16 by a heater driving circuit portion 28 (see FIGS. 2 and 4A to 4C) serving as an electric power supply portion (a heating unit).

Reference numerals 23 and 26 designate an entrance guide and a sheet discharging fixing roller which are assembled in the apparatus frame 24, respectively. The entrance guide 23 guides the recording material P such that the recording material P passed through the secondary transferring nip can be accurately guided to the fixing nip portion 27 of the pressure contact portion between the fixing belt 20 and the pressure roller 22 in the portion of the fixing heater 16. In this embodiment, the entrance guide 23 is formed of polyphenylenesulfide (PPS) resin.

The pressure roller 22 is driven and rotated at a predetermined circumferential rate in a counterclockwise direction of an arrow by a driving unit (not shown). Due to the rotation of the pressure roller 22, pressure contact friction force between the outer surface of the pressure roller 22 and the fixing belt 20 occurs in the fixing nip portion 27. The friction force causes rotational force acting on the cylindrical fixing belt 20, and the fixing belt 20 is accordingly rotated in a clockwise direction of an arrow around the heater holder 17 with the inner surface of the fixing belt 20 being in close contact with and slid on the downward facing surface of the fixing heater 16. The inner surface of the fixing belt 20 is coated with grease to achieve sliding characteristic between the heater holder 17 and the inner surface of the fixing belt 20.

Under a start-up temperature control condition under which the pressure roller 22 is rotated, the cylindrical fixing belt 20 is accordingly rotated, and the fixing heater 16 is supplied with current and heated up to a predetermined temperature, the recording material P bearing unfixed toner images is guided along the entrance guide 23 and introduced into the fixing nip portion 27 between the fixing belt 20 and the pressure roller 22. The toner image bearing surface of the recording material P is brought into contact with the outer surface of the fixing belt 20 at the fixing nip portion 27, and the recording material P is nipped and conveyed through the fixing nip portion 27 in synchronization with the rotation of the fixing belt 20. During the nipped conveyance of the recording material P, heat of the fixing heater 16 is transmitted to the recording material P through the fixing belt 20, and the unfixed toner image t on the recording material P is heated and pressed on the recording material P. The unfixed toner image t is thus melt and fixed on the recording material P. Upon passing of the recording material P through the fixing nip portion 27, the recording material P is self-stripped from the surface of the fixing belt 20 by curvature, and discharged by the sheet discharging fixing roller 26.

2) Fixing Heater 16

In connection with the fixing heater 16 serving as the heating source in this embodiment, a substrate of aluminum nitride is coated with a layer of conductive paste including alloy of silver and palladium with a uniform thickness by a screen printing method. The thus-formed resistance heating member is coated with pressure resisting glass, and a ceramic heater is thus produced for use.

Figure 4A:
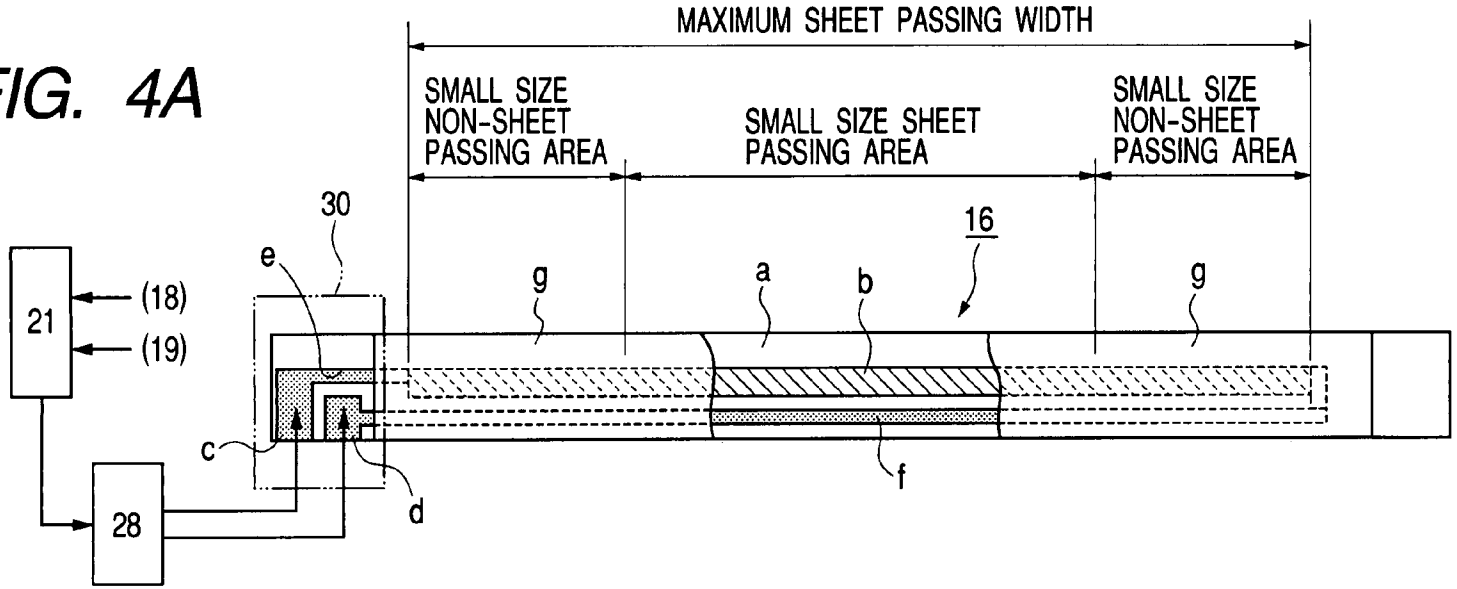
FIGS. 4A, 4B and 4C are views schematically illustrating the structure of a ceramic heater serving as a heating member, respectively.
Figure 4B:
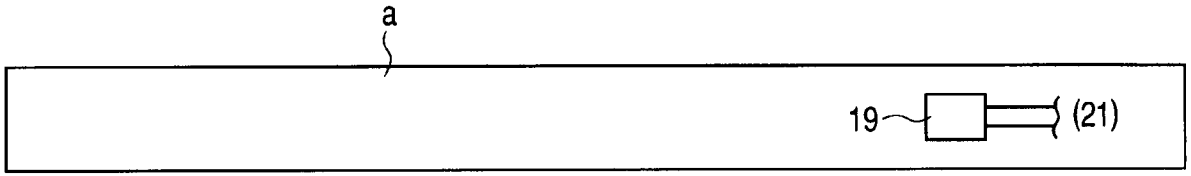
Figure 4C:
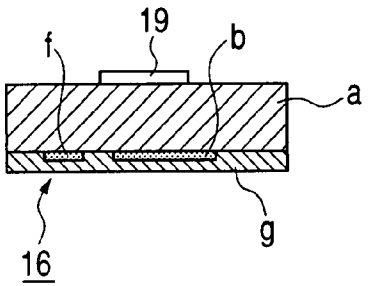

FIGS. 4A to 4C illustrate an example of such a ceramic heater. FIG. 4A is a partially-cut-away schematic front surface view, FIG. 4B is a schematic rear surface view, and FIG. 4C is an enlarged schematic cross-sectional view.

The fixing heater 16 includes the following elements:

(1) An elongate substrate a of aluminum nitride extending in a direction perpendicular to the sheet passing direction, (2) A resistance heat-generating layer b of conductive paste including an alloy of Ag and Pd for generating heat by current supply thereto, which is formed by performing line-shaped or band-shaped coating on the front surface of the aluminum nitride substrate a along its longitudinal direction by the screen printing method, with a thickness of about 10 microns and a width of about 1 mm to 5 mm, (3) First and second electrode portions c and d, and first and second extended electric path portions e and f, which are similarly pattern-formed on the front surface of the aluminum nitride substrate a as power supply patterns to the resistance heat-generating layer b by a silver-paste screen printing method or the like, (4) A thin glass coat g with a thickness of about 10 microns which is formed on the resistance heat-generating layer b, the extended electric path portions e and f, and the like to secure their protection and insulation, and is capable of resisting against sliding friction with the fixing belt 20, and (5) The sub thermistor 19 provided on the rear surface of the aluminum nitride substrate a.

The fixing heater 16 is fixedly supported by the heater holder 17 with its front surface facing downward and being exposed. A connector 30 for power supply is mounted to the side of the first and second electric path portions c and d of the fixing heater 16. Power is supplied from a heater driving circuit portion 28 to the first and second electrode portions c and d through the power supply connector 30. The resistance heat-generating layer b is thus heated, and the temperature of the fixing heater 16 is rapidly raised. The heater driving circuit portion 28 is controlled by the control circuit portion (CPU) 21.

In an ordinary use, upon start of rotation of the pressure roller 22, the fixing belt 20 accordingly begins to rotate, and the temperature on the inner surface of the fixing belt 20 rises as the temperature of the fixing heater 16 rises. Power supply to the fixing heater 16 is controlled by the PID control, and the input power is controlled such that the temperature on the inner surface of the fixing belt 20, i.e., temperature detected by the main thermistor 18, reaches 190° C.

3) Fixing Belt 20

In this embodiment, the fixing belt 20 is a cylindrical (endless-belt shaped) member constructed by forming an elastic layer on a belt-shaped member. Specifically, a silicone rubber layer (an elastic layer) with a thickness of about 300 microns is formed by a ring coat method on a cylindrical endless belt (a belt substrate material) with a thickness of 30 microns formed of material of SUS, and the thus-formed silicone rubber layer is coated with a PFA resin tube (an uppermost layer) with a thickness of 30 microns. Thermal capacity of the thus-constructed fixing belt 20 is measured, and a measurement value of $12.2\times10^{-2}$ J/cm$^2$·° C. (thermal capacity per 1 cm$^2$ of the fixing belt) is obtained.

(1) Substrate Layer of the Fixing Belt

Although polyimide or the like can be used as the substrate layer of the fixing belt 20, heat conductivity of SUS is approximately ten (10) times larger than that of polyimide, and higher on-demand characteristic can be obtained by SUS. Accordingly, SUS is used as the substrate layer of the fixing belt 20 in this embodiment.

(2) Elastic Layer of the Fixing Belt

A rubber layer having high heat conductivity is used as the elastic layer of the fixing belt 20, thereby obtaining higher on-demand characteristic. Specific heat of the material used in this embodiment is about $12.2\times10^{-1}$ J/g·° C.

(3) Separating Layer of the Fixing Belt

Fluorine-contained resin layer is formed on the surface of the fixing belt 20 to improve the separating characteristic of the surface. It is accordingly possible to prevent the offset phenomenon which is caused by the fact that toner is once attached to the surface of the fixing belt 20, and is again transferred to the recording material P. Further, when the fluorine-contained resin layer on the surface of the fixing belt 20 is a PFA tube, it is possible to form a uniform fluorine-contained resin layer more readily.

(4) Thermal Capacity of the Fixing Belt

Generally, as the thermal capacity of the fixing belt 20 increases, the temperature start-up becomes blunt and the on-demand characteristic is degraded. For example, when it is assumed that no stand-by temperature control is conducted and the start-up is performed in a minute, thermal capacity of the fixing belt 20 needs to be smaller than about 4.2 J/cm$^2$·° C. though it depends on the structure of the fixing apparatus.

This embodiment is designed such that the fixing belt 20 can be heated up to 190° C. within twenty (20) seconds at the time of start-up from room temperature when electric power of about 1,000 W is supplied to the fixing heater 16 as a standard. The material having the specific heat of about $12.2\times10^{-1}$ J/g·° C. is used as the silicone rubber layer. Here, the thickness of silicone rubber needs to be below 500 microns, and the thermal capacity of the fixing belt 20 needs to be below about $18.9\times10^{-2}$ J/cm$^2$·° C. Conversely, if it is intended that the thermal capacity be less than $4.2\times10^{-2}$ J/cm$^2$·° C., the rubber layer of the fixing belt 20 will be excessively thin, and hence this fixing apparatus becomes equivalent to an on-demand fixing apparatus without the elastic layer in the light of image quality such as OHT permeability and gloss unevenness.

In this embodiment, the thickness of the silicone rubber needed for achievement of high image quality relevant to OHT permeability and gloss setting is above 200 microns. Thermal capacity in this case is $8.8\times10^{-2}$ J/cm$^{2}\cdot$° C.

In other words, in constructions of fixing apparatuses similar to this embodiment, thermal capacity of the fixing belt 20 is generally in a range above $4.2\times10^{-2}$ J/cm$^{2}\cdot$° C. and below 4.2 J/cm$^{2}\cdot$° C. Among them, a fixing belt with thermal capacity above $8.8\times10^{-2}$ J/cm$^{2}\cdot$° C. and below $18.9\times10^{-2}$ J/cm$^{2}\cdot$° C. is used in this embodiment to satisfy both higher on-demand characteristic and higher image quality.

(3) Predicting Method of the Maximum Supply Power to be Input into the Fixing Apparatus In this embodiment, the value of the maximum supply power to the fixing heater 16 is predicted according to the rise time of the temperature detected by the main thermistor 18 from the start of power supply to the fixing heater 16, and the output power is corrected according to the maximum supply power value at the time of output of electric power necessary for a stable operation of the fixing apparatus. Thereby, irrespective of variations in the input voltage and the resistance value of the fixing heater 16, overshoot and under shoot are prevented, and stable temperature control is performed even at the start-up time and at the time of start of the sheet passing. The above control is executed by the control circuit portion (CPU) 21.

In this embodiment, the prediction method of the maximum supply power to be input into the fixing apparatus is as follows. Full power (100%) is supplied during the start-up temperature control time, and the temperature rise time of the fixing heater 16 serving as the heating member is measured from the temperature detected by the sub thermistor 19, thereby predicting the maximum supply power. Specifically, time T (msec) required for the temperature detected by the thermistor 19 to rise from 150° C. to 210° C. during the start-up temperature control time is measured, and the prediction maximum supply power E (W) is calculated by the following formula (1), $$E=2{,}000-0.76\times T+0.00010\times T^2 \quad (1)$$

The prediction formula used here is what is optimized in a fixing apparatus as has the same construction as this embodiment, and accordingly this formula should be appropriately altered according to the structure and various conditions of an apparatus to which the present invention is applied. Naturally, the formula must be modified according to the temperature range for which time of the start-up rising curve is measured.

In other words, as the relationship between the time of the start-up rising curve and the supply power, the following formula is used $$E=\alpha+\beta\times T+\lambda\times T^2 \quad (2)$$

And, in the fixing apparatus as has the same construction as this embodiment, when the relationship between the supply power and the temperature rise time necessary for the temperature detected by the sub thermistor 19 to rise from 150° C. to 210° C. is to be shown, the prediction formula as written by formula (1) is used since a formula with such coefficients as shown in formula (1) well represents such relationship. Simple coefficients are used to reduce load imposed on the control circuit portion (CPU) 21. It is not always necessary to use a second order polynomial as the prediction formula. It is also possible to omit the second order term, further use a higher order term, or use a formula of a different representation, depending on the construction of the fixing apparatus.

Figure 5:
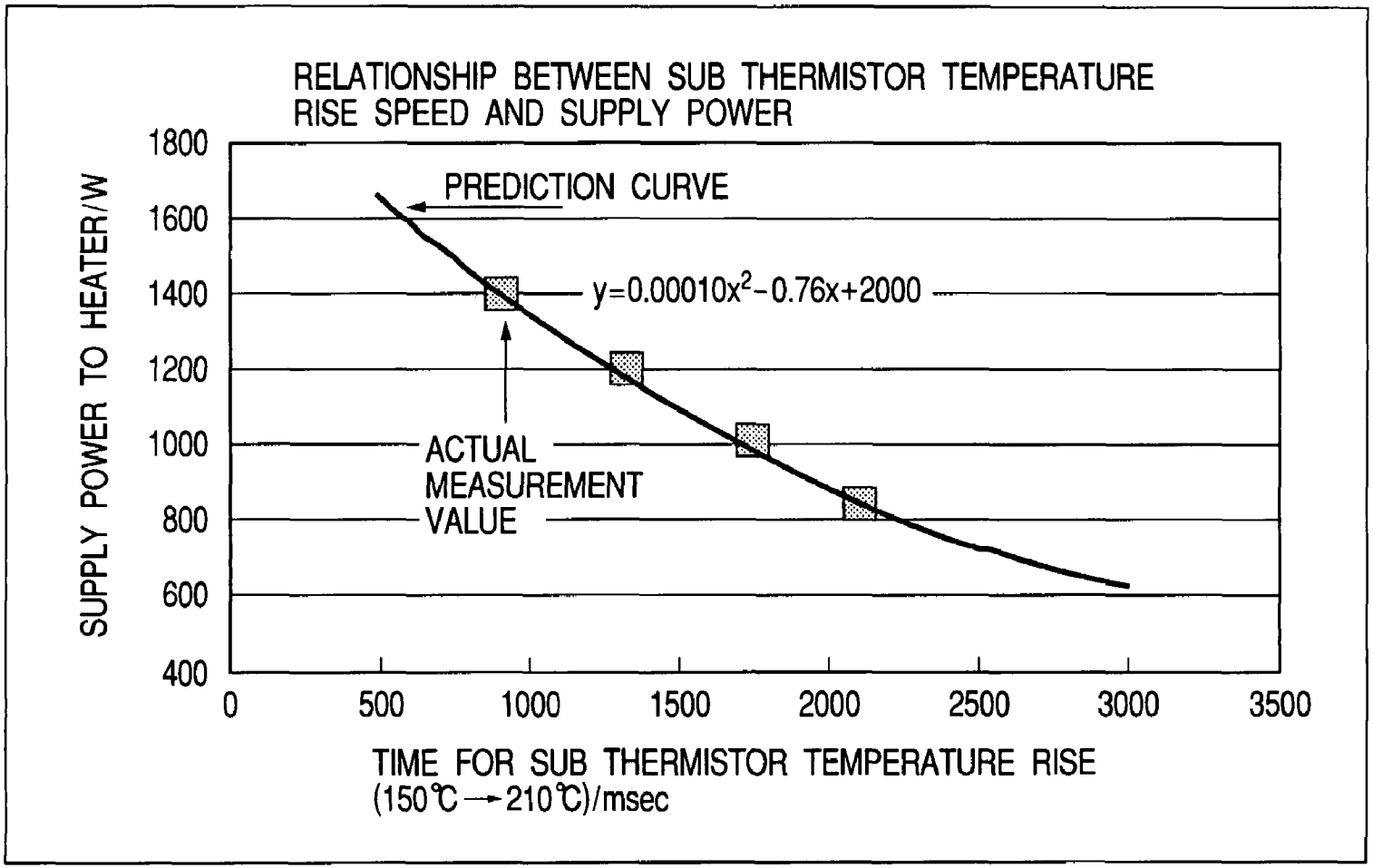
FIG. 5 is a graph showing the relationship between rise speed of temperature of a sub thermistor and supply of electric power at the time when a fixing apparatus in a first embodiment according to the present invention is used.

FIG. 5 shows a comparison result between the above-discussed prediction formula and actual measurement values. Time necessary for the temperature detected by the sub thermistor 19 to rise from 150° C. to 210° C. is measured by A/D converting the output of the thermistor in the in-line electrophotographic color image forming apparatus used in the test. On the other hand, the actual supplied electric power is measured by A/D converting the output of a power value through WT200 DIGITAL POWER METER (product by YOKOGAWA) by NR250 (product by KEYENCE) of a temperature recorder for PC, and taking the result into PC.

As shown in FIG. 5, the actual measurement value and the prediction formula well coincide with each other. It can be thus understood that a precise maximum supply power can be obtained by this embodiment.

In this embodiment, the prediction value is not updated when the temperature detected by the sub thermistor 19 before the start-up temperature control is above 140° C., since the prediction value of the maximum supply power using the start-up temperature control cannot be calculated when the temperature detected by the sub thermistor 19 before the start-up temperature control exceeds a measurement range.

Figure 16:
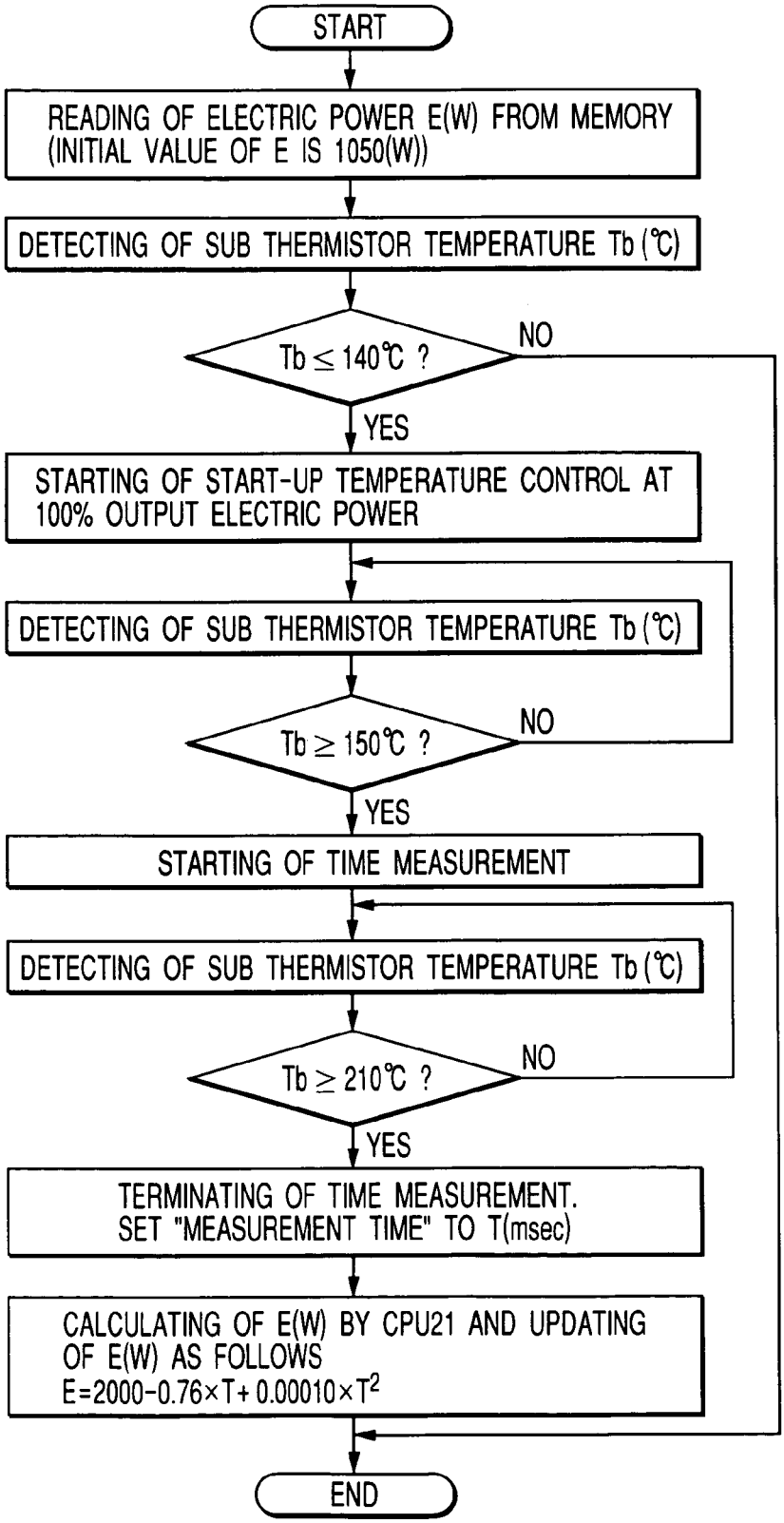
FIG. 16 is a flow chart showing a method of predicting the maximum supply power input into a fixing apparatus in a first embodiment according to the present invention.

FIG. 16 shows a flow chart of the prediction method of the maximum supply power to be input into the fixing apparatus of this embodiment. A precise maximum supply power can be obtained by using the temperature detected by the sub thermistor in such a manner.

In this embodiment, as the temperature range for measuring time of the start-up rise curve, the detection temperature of the sub thermistor 19 from 150° C. to 210° C. is used. This range is determined from the following conditions.

1) Lower Temperature Limit of the Temperature Range

The lower limit is an initial temperature of the sub thermistor, and hence is at least above temperature of its use environment.

When a lower temperature side is used, the rise curve becomes too steep, and an error of power prediction hence increases.

Use temperature environment and heat storage condition of the fixing apparatus have influences thereon (correction is occasionally needed).

2) Upper Temperature Limit of the Temperature Range

The upper limit is the maximum driving temperature at the start-up time.

Since the measurement time of the rise curve increases as the upper limit becomes higher, reflection of the power prediction is delayed.

From those standpoints of view, the detection temperature of the sub thermistor 19 from 150° C. to 210° C. is deemed most preferable as the temperature range for measuring time of the start-up rise curve, and this range is used in this embodiment. From the above conditions, it is preferable to use any range within a range from 70° C. to 230° C. as the temperature range of the rise curve, but it is not always necessary to use a range within this range.

(4) Temperature Control of the Fixing Apparatus

In this embodiment, temperature control is performed basically by a method in which the main thermistor 18 is brought into contact with the inner surface of the fixing belt 20 to detect the temperature of the fixing belt, and power supply to the fixing heater 16 is controlled by feedback control such as the PID control.

On the other hand, at the start-up time and the time of start of sheet passing of the fixing apparatus, the following control is executed to further improve precision of temperature control, and prevent overshoot/undershoot. Its detail is as follows.

1) Temperature Control at the Start-Up Time

In this embodiment, in order that the apparatus can be promptly started up without occurrence of excessive overshoot, a time zone for prohibiting the feedback control is provided during the start-up temperature adjustment control, and a plurality of power levels are used to control the power. The temperature can be thus controlled stably without occurrence of overshoot.

In this embodiment, plural levels of electric power to be supplied to the fixing heater 16 include a first power level for speedily raising the temperature of the fixing apparatus, and a second power level for preventing overshoot and stabilizing the temperature of the fixing apparatus, and those levels are switched each other in predetermined timing during the start-up temperature control.

Further, the second power level is occasionally appropriately corrected to a necessary power value established considering the heat storage condition of the fixing apparatus.

Specifically, the following control is performed.

In this embodiment, the start-up control is conducted in the order of "output of first start-up power (100% full output)," "detection of temperature rise time (prediction of the maximum supply power)," "supply of first corrected start-up power," "detection of predetermined temperature," "supply of second corrected start-up power," and "corrected PID control."

A method of correcting the power will be described in the first place.

The following correction formula is used for correction of power.

"Corrected output power ratio (%)"="output power ratio on control (%)×correction coefficient"

"Correction coefficient"="maximum supply power as standard (1,050 *W*)"/"maximum supply power obtained from temperature rise speed (*W*)"

In the above formula, the upper limit of the corrected output power ratio is 100%, and this power ratio is treated as 100% in the event that the calculated corrected output power ratio exceeds 100%.

Here, the reason for using 1,050 W as the standard maximum supply power is that this value is a typical maximum supply power value under use conditions. This standard can be occasionally appropriately changed.

Results in the case of the above-discussed correction are shown in Table 3. For example, under a condition under which the output power should be 50% output when the maximum supply power is 1,050 W, outputs are 67.8% and 38.5% of full electric powers when the maximum supply powers are 750 W and 1,500 W, respectively. Resultantly, the same power is output. Without such correction, powers of 325 W and 750 W are output in the event that the maximum supply powers are 750 W and 1,500 W, respectively. Since no power over the full power (100%) of the maximum supply power can be output, 100% power is output in such a case.

TABLE 3

Power correction in cases of 750 W, 1,050 W and 1,500 W

| Output power ratio | Power/W (output power ratio) After correction | | |
|---|---|---|---|
| | 750 W | 1,050 W | 1,500 W |
| 0% | 0 (0%) | 0 (0%) | 0 (0%) |
| 20% | 210 (27.1%) | 210 (20%) | 210 (15.4%) |
| 50% | 525 (67.8%) | 525 (50%) | 525 (38.5%) |
| 80% | 750 (100%) | 840 (80%) | 840 (61.7%) |
| 100% | 750 (100%) | 1,050 (100%) | 1,050 (77.1%) |

When the output power ratio is corrected according to the prediction maximum supply power in such a manner, the temperature can be stably controlled regardless of variations in the maximum supply power. Accordingly, when the control parameter is optimized such that the power control can be optimum in the event that the maximum supply power is 1,050 W, optimum control can be achieved by the above-discussed correction method even in cases of different electric powers.

Output timing of the first and second start-up electric powers will be described.

After output of the first start-up power (100%), correction of the first start-up power is executed at the time when time necessary for the temperature detected by the sub thermistor 19 to rise from 150° C. to 210° C. is measured, and the prediction value of the maximum supply power is determined by the above-discussed method. After output of the first corrected start-up power, timing of change to the second power and supply time of the second power are set as shown in Table 4. With respect to electric powers other than those described in Table 4, those obtained by linear interpolation from powers indicated in Table 4 are used.

TABLE 4

Relationship between predicted maximum supply power, timing of change to second power, and supply time of second power

| Power (W) | Change to second power (difference from object temperature (° C.)) | Supply time of second power (seconds) |
|---|---|---|
| 1,500 | 45 | 1 |
| 1,350 | 42 | 0.8 |
| 1,200 | 38 | 0.6 |
| 1,050 | 34 | 0.4 |
| 900 | 28 | 0.2 |
| 750 | 20 | 0 |

Reasons for changing the switch timing depending on the maximum supply power as discussed above are as follows.

When the maximum supply power is large, full power is supplied, and the power is then earlier changed to the second power, considering the fact that temperature of the fixing heater 16 increases largely by the time when prediction of the maximum supply power by the sub thermistor 19 is completed. Instead, supply time of period of the second power is made longer.

When the maximum supply power is small, supply time of the first power is made as long as possible to shorten the start-up time since the corrected output power ratio cannot be over 100% after completion of prediction of the maximum supply power. Instead, supply time of the second power is made shorter.

Thus, temperature control with small overshoot can be executed regardless of variations in the maximum supply power.

2) Temperature Control at the Time of Start of Sheet Passing

In this embodiment, in synchronization with the rush-in timing of the recording material P at the time of starting the sheet passing, the PID control is not executed for a predetermined time of period, and when electric power to be supplied to the fixing heater 16 is corrected to a predetermined value and then supplied, the electric power is corrected to an approximately necessary electric power value established considering the thermal characteristic of the recording material P and the heat storage condition of the fixing apparatus. Thereby, the temperature is stably controlled without generating temperature variations accompanying the rush-in of the recording material P at the time of start of the sheet passing due to dead time (time lag) of the temperature detection.

Specifically, the PID control is executed before and after the sheet passing. The PID control is not performed for about 0.3 second to about 0.7 second prior to the rush-in of the recording material at the time of start of the sheet passing, and approximately necessary power value is supplied at the time of sheet passing. Thereafter, the PID control is recovered. For example, power is about 500 W immediately after the start-up from the room temperature condition for passing of a plain paper sheet. In other words, when the standard maximum supply power is 1,050 W, the output is about 47.5% thereof.

The above-stated correction formula is similarly used for correction of the power. That is, where about 500 W is needed, outputs are about 66.5% and 33.25% of full electric powers when the maximum supply powers are 750 W and 1,500 W, respectively. As a result, the same power (500 W) is output. Also in this case, if the control parameter is optimized such that the power control can be optimum in the event that the maximum supply power is 1,050 W, optimum control can be achieved by the correction even in cases of different electric power.

In this embodiment, the supply time of 0.7 second of the predetermined power can be changed according to the maximum supply power. The reason therefor is as follows. When the maximum supply power is large, an error of the prediction value becomes relatively large since the temperature rise time is short. On the other hand, when the maximum supply power is small, an error of the prediction value becomes relatively large since the temperature rise time is long and the error is hence influenced by the heat storage condition of the fixing apparatus, use environment, and the like. That is, in order that influence of a difference between the prediction value obtained by the prediction formula and the actual maximum supply power can be reduced, the supply time of the predetermined power is slightly shortened when the maximum supply power is remote from 1,050 W of the standard value. Specifically, in the event that the maximum supply power is above 1,500 W, or below 700 W, the supply time of the predetermined power is set to about 0.3 second to about 0.5 second prior to the rush-in of the recording material at the time of start of sheet passing.

3) Second Power at the Start-Up Time, and Supply Time of the Predetermined Power at the Time of Start of Sheet Passing As discussed above, the reason for supplying power to prevent temperature variations at times near timing in which the temperature detected by the thermistor reaches the target temperature, and near timing in which the recording material ruches in the fixing nip 27 at the start-up time of the fixing apparatus and at the time of start of sheet passing is as follows.

(1) Heat conductivity of the silicone rubber layer used as the elastic layer of the fixing belt 20 is small, and many members are present in a location from the fixing heater 16 to the surface of the fixing belt. Accordingly, the so-called heat response is poor, i.e., time from the start of supply of electric power to the fixing heater 16 to the temperature rise of the fixing belt is long.

(2) The location of the temperature detecting unit 18 for detecting the temperature of the fixing belt 20 is away from the fixing nip portion 27, and hence detection timing of the fixing nip portion is likely to be delayed.

Since the heat conductivity of the fixing belt is poor as described in (1), it is desirable to supply power of the necessary value during approximately one-turn rotation of the fixing belt such that the fixing belt can be overall heated at the times of power supply at the start-up time and at the time of start of sheet passing. Further, since the temperature detecting timing of the fixing nip portion is delayed as discussed in (2), it is desirable to supply power of the necessary value for about time of the delay at the times of power supply at the start-up time and at the time of start of sheet passing.

Therefore, necessary time of power supply needed for stabilization of the temperature at the start-up time and the temperature behavior at the time of start of sheet passing is about equal to $(a+L)/V$ where V is the process speed or the moving speed of the outer circumference of the fixing belt 20, a is the length from the pressure contact portion to the temperature detecting location, and L is the outer circumferential length of the fixing belt 20.

On the other hand, in use of the actual apparatus, there can be a case where an error occurs between the necessary power value and the predicted power value under influences of heat storage condition, use environment, variations in members and structure of the fixing apparatus. In the event of occurrence of the error, fluctuation of the controlled temperature becomes larger as the time of power supply increases. Further, there is a case where power cannot be supplied so long due to necessity of prompting the start-up under restriction of the start-up time. For those reasons, it is desirable that the actual time of power supply is made shorter than the above-stated ideal supply time.

Therefore, more preferable time t of supply of necessary power at the start-up time and at the time of start of sheet passing can be represented by $t \leqq (a+L)/V$.

In this embodiment, time of power supply is preferably within 1.12 seconds since the process speed is 87 mm/sec, the length from the pressure contact portion to the temperature detecting location is 20 mm, and the outer circumferential length of the fixing belt 20 is 77.6 mm. Naturally, the time is not limited to the above value in the present invention.

4) PID Control

In this embodiment, also with respect to the power controlled by the PID control, the output power ratio is corrected according to the prediction maximum supply power. The output power ratio determined by the PID control is similarly corrected using the above-stated correction formula.

In the PID control of conventional fixing apparatuses, the control is performed in such a manner that the output power ratio is increased 2.5% when the temperature detected by the main thermistor is 2° C. short of the target temperature, for example. In this embodiment, when the temperature detected by the main thermistor is 2° C. short of the target temperature, output power ratios are increased 1.79%, 2.5% and 3.57% where the maximum supply power are 750 W, 1,050 W and 1,500 W, respectively. Accordingly, in the event that the temperature detected by the main thermistor is 2° C. short, the power is increased about 26.25 W irrespective of the maximum supply power.

Also in this case, if the control parameter is optimized such that the power control can be optimum in the event that the maximum supply power is 1,050 W, optimum control can be achieved by the correction even in cases of different electric power.

Figure 17:
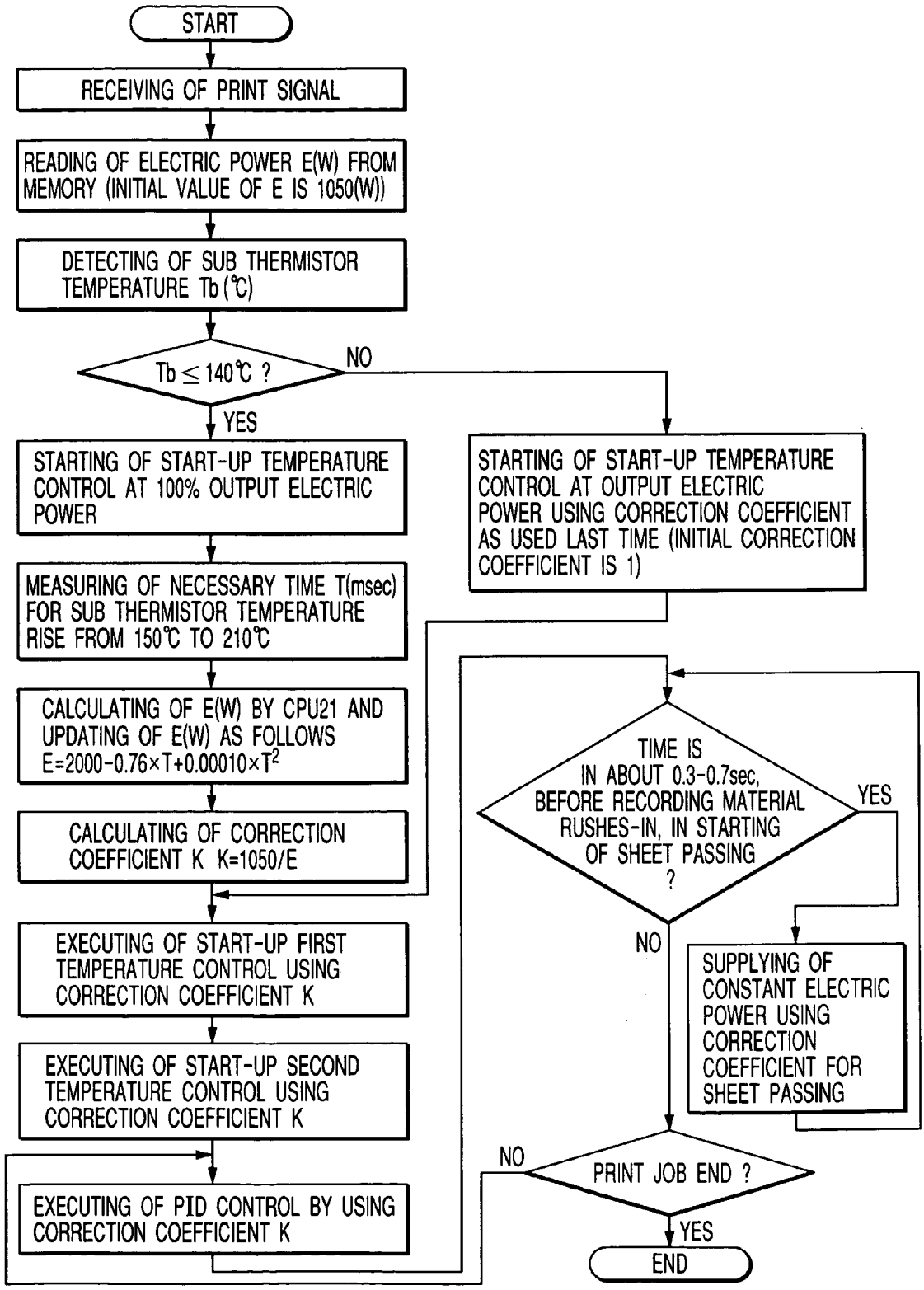
FIG. 17 is a flow chart showing a method of controlling temperature of a fixing apparatus in a first embodiment according to the present invention.

FIG. 17 shows a flow chart of the temperature control of the fixing apparatus based on the prediction maximum supply power. When the power is thus controlled based on the predicted maximum supply power, the temperature can be stably controlled regardless of change in the maximum supply power accompanying variations in the input voltage and the resistance value of the fixing heater 16.

(5) Experimental Result when this Embodiment is Used

1) Method of Experiment

The fixing apparatus under the room temperature condition is used. After the start-up, conditions of temperatures detected by main and sub thermistors and supply power to the fixing heater 16 at the time when a sheet of paper is printed are measured in the events of the maximum supply power of 800 W, 880 W, 1,030 W, 1,190 W and 1,440 W, respectively.

The temperature detected by each thermistor is measured by A/D converting the output of the thermistor in the in-line electrophotographic color image forming apparatus used in the test. On the other hand, the actual supplied electric power is measured by A/D converting the output of a power value through WT200 DIGITAL POWER METER (product by YOKOGAWA) by NR250 (product by KEYENCE) of the temperature recorder for PC, and taking the result into PC.

Gloss of the fixed image is measured by the following method. A glossmeter PG-3D (product by NIHON DENSHOKU KOGYO Co.) is used, and measurement is conducted by the 75-degree specular surface gloss measuring method of JIS Z 8741. As for the amount of toner on the recording material, fixation is performed under conditions under which the amounts of toner in solid image portions of so-called primary colors of Y, M, C and Bk are about 0.5 to 0.6 mg/cm$^2$, and the amounts of toner in solid portions of so-called secondary colors of R, G and B are about 1.0 to 1.2 mg/cm$^2$, and the gloss of the fixed image is measured.

Further, where the maximum supply powers are respectively 800 W, 880 W, 1,030 W, 1,190 W and 1,440 W, the endurance test is performed as follows. The fixing apparatus of this embodiment is used, 150 k sheets are printed with two-sheet intermittent continuous printing, and torque of the driving roller after the endurance is measured.

2) Experimental Result

Figure 6:
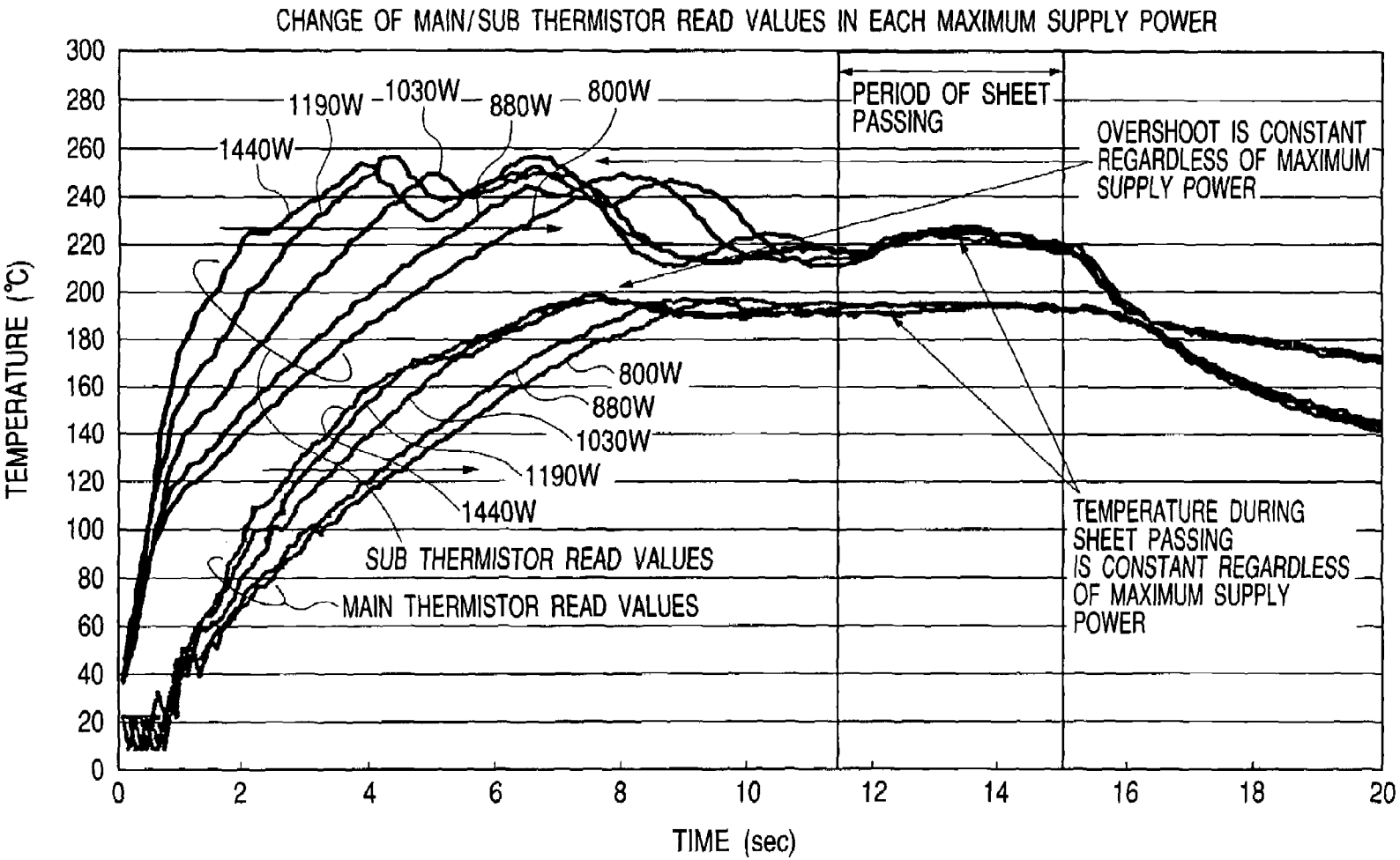
FIG. 6 is a graph showing a change in detection temperature of main and sub thermistors at the time when start-up temperature control is executed using a fixing apparatus in a first embodiment according to the present invention.

FIG. 6 shows temperatures detected by main and sub thermistors at the time when a sheet of paper is printed after the start-up from the room temperature condition in the fixing apparatus of this embodiment, where the maximum supply powers are respectively 800 W, 880 W, 1,030 W, 1,190 W and 1,440 W.

It can be understood from FIG. 6 that an appropriate start-up condition is precisely achieved within about ten (10) seconds in both the main and sub thermistors irrespective of difference in the maximum supply power. Further, it can be understood that the temperature is precisely controlled even during the period of sheet passing. Thus, fluctuation width in gloss of the output printed matter is within about four in monochrome, and is within about six in secondary color. Furthermore, no poor fixation, such as hot offset, degradation of fixing characteristic, appears regardless of the recording material and the image pattern.

Moreover, the temperature detected by the sub thermistor 19 never exceeds 260° C. irrespective of difference in the maximum supply power. Further, when the driving torque is measured after the endurance test, the result is about 24.5 to 31.3 N·cm (about 2.5 to 3.2 kgf·cm). Here, no malfunction of the fixing apparatus appears.

(6) Comparative Example

Control of a conventional fixing apparatus used as the comparative example will be described.

In the conventional fixing apparatus, when the temperature detected by the main thermistor 18 reaches a predetermined temperature ((a target temperature)−38° C.: 195° C.−38° C.=157° C. in this embodiment since the target temperature is 195° C.) after supply of "the start-up power (100% full output)," "a predetermined electric power of the second power level" is fixed at a 37.5% output and supplied for about 0.6 seconds. The condition is then changed to "PID control." Further, in the plain paper sheet passing immediately after the start-up from the room temperature condition, the PID control is not executed for about 0.3 seconds to about 0.7 seconds prior to the rush-in of the recording material at the time of start of sheet passing, and about 47.5% power is output as a predetermined power of approximately necessary power value at the time of sheet passing. Thereafter, the PID control is recovered to control the power supply to the fixing heater 16.

1) Method of Experiment

The experiment is conducted similar to the experiment using this embodiment, and hence description thereof is omitted. However, the conventional fixing apparatus is controlled as discussed above.

2) Experimental Result

Figure 7:
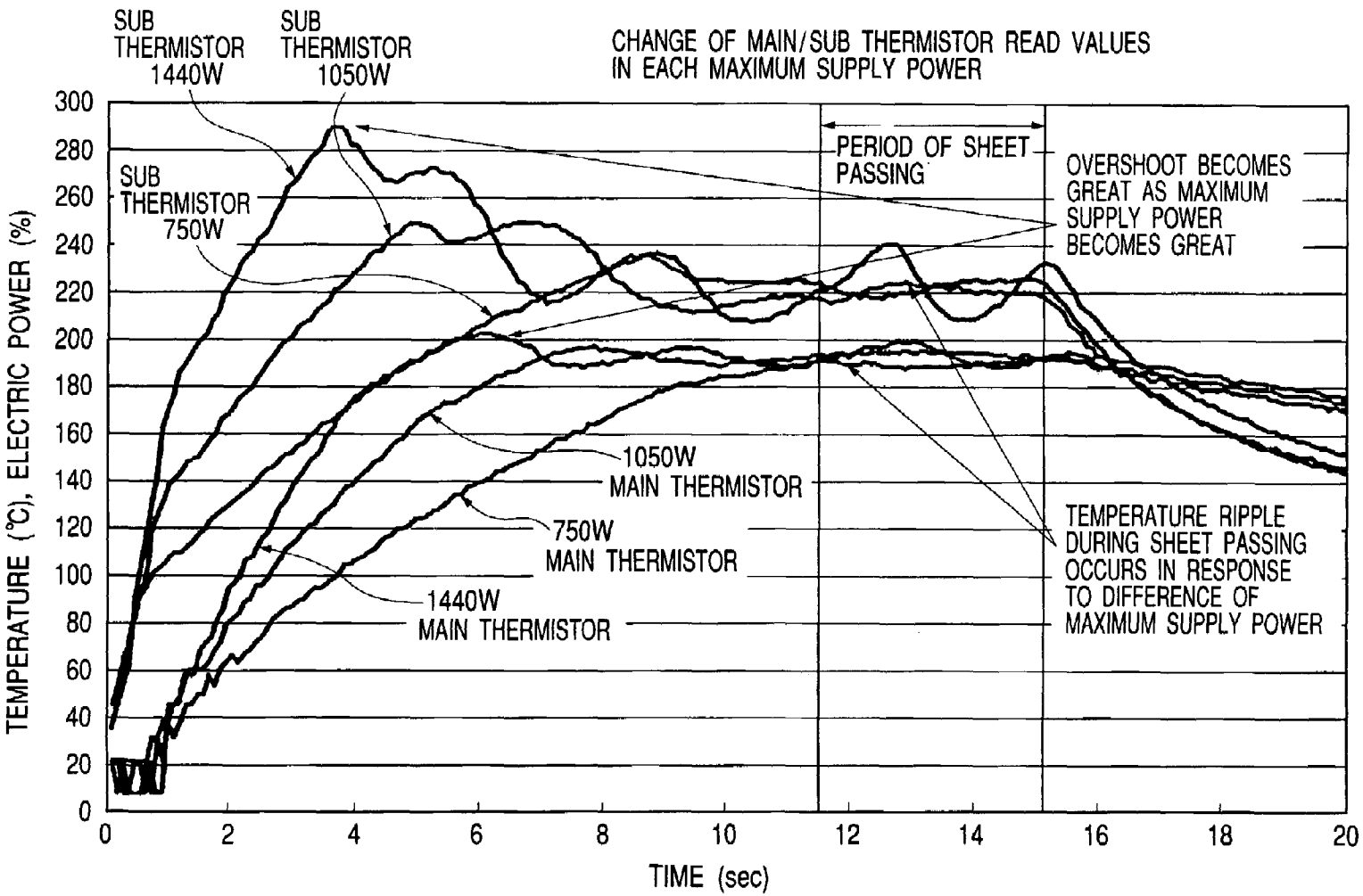
FIG. 7 is a graph showing a change in detection temperature of main and sub thermistors at the time when start-up temperature control is executed using a conventional fixing apparatus.

FIG. 7 shows temperatures detected by main and sub thermistors at the time when a sheet of paper is printed after the start-up from the room temperature condition in the conventional fixing apparatus, where the maximum supply powers are respectively 750 W, 1,050 W and 1,440 W.

Thus, when the maximum supply power is large, a first sheet passing occurs without convergence of large temperature ripple though the start-up is rapid. Further, during the sheet passing, the temperature ripple cannot be reduced to a desired ripple (about 7° C.), and the maximum ripple of about 12° C. appears in all cases of the maximum supply power of 750 W, 1,050 W and 1,440 W. Accordingly, in the in-line electrophotographic color image forming apparatus used in the test, fluctuation in gloss of the output printed matter is about seven (7) in monochrome, and is eleven (11) in secondary color, and the image quality is thus lowered. Further, poor fixation, such as hot offset and degradation of fixing characteristic, appears accompanying large fluctuation in temperature, depending on the recording material and the image pattern.

Furthermore, overshoot is large when the maximum supply power is great, and the temperature detected by the sub thermistor 19 exceeds 290° C. in the event that the maximum supply power is 1,440 W. When such drive is repeated, thermal degradation of members in the fixing apparatus occurs. When the maximum supply power is 1,440 W, driving torque measured after the endurance test is about 43.1 N·cm. Here, slip of the fixing belt is likely to occur during drive of the fixing apparatus depending on conditions.

(7) Consideration

The overshoot and temperature ripple will be described in the first place.

Conditions of power control in the event of the above-discussed experiment will be described for cases where the conventional fixing apparatus is used and where the fixing apparatus of this embodiment is used.

Figure 8:
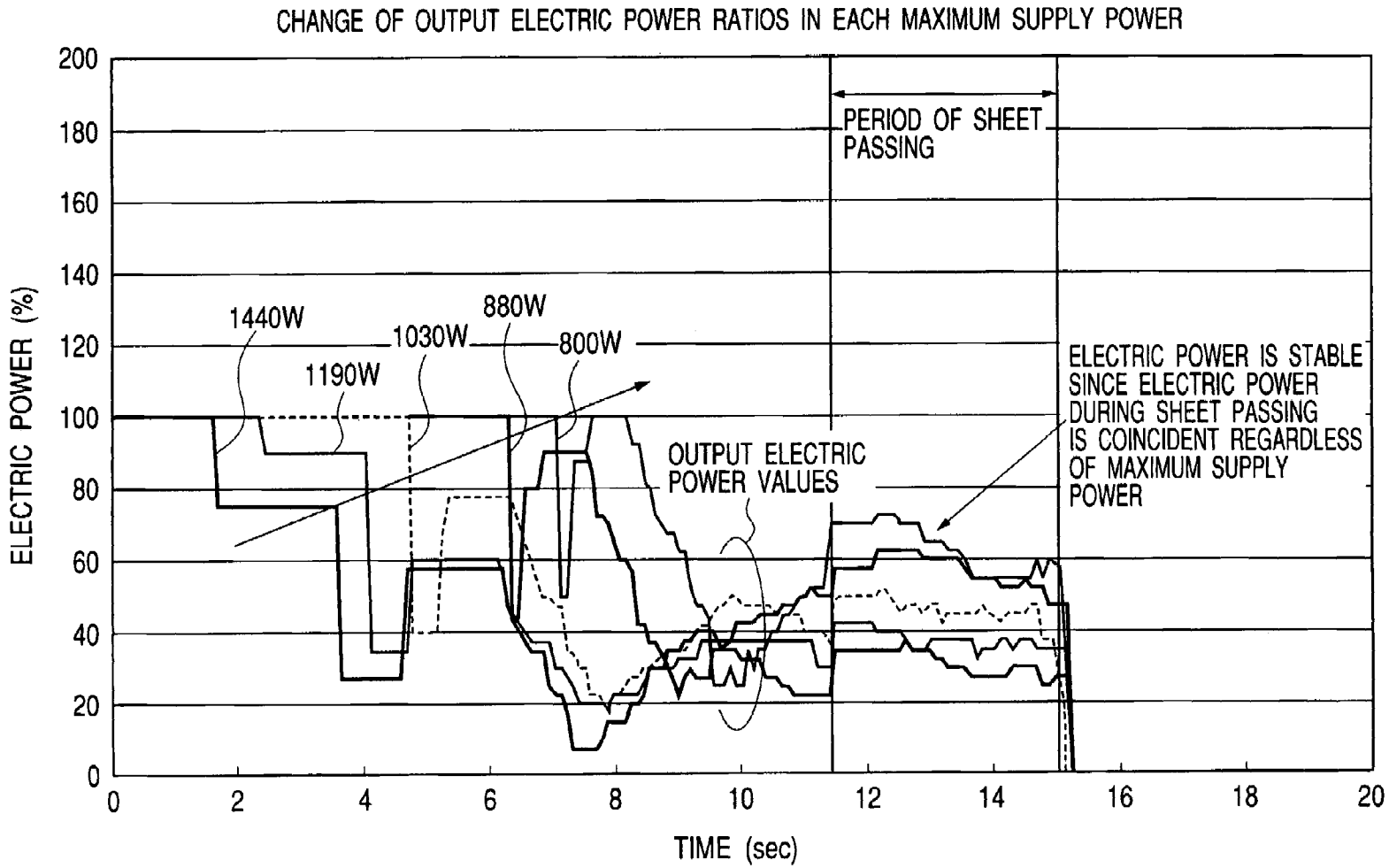
FIG. 8 is a graph showing a change in output electric power ratio at the time when start-up temperature control is executed using a fixing apparatus in a first embodiment according to the present invention.

FIG. 8 shows supply power ratios to the fixing heater 16 at the time when a sheet of paper is printed after the start-up from the room temperature condition in the fixing apparatus of this embodiment, where the maximum supply powers are respectively 800 W, 880 W, 1,030 W, 1,190 W and 1,440 W.

From FIGS. 6 and 8, when the maximum supply power is large, the following cases cannot be considered to occur. That is, the case where power is promptly changed to the second power, and the case where excessive overshoot occurs due to correction of the output power ratio. Further, it can be understood that power control is converged in about ten (10) seconds, and the correction of the output power ratio effectively works. Moreover, it can be considered that almost no disturbance of the output power ratio occurs even at the time of start of sheet passing, and the correction effectively works.

Figure 9:
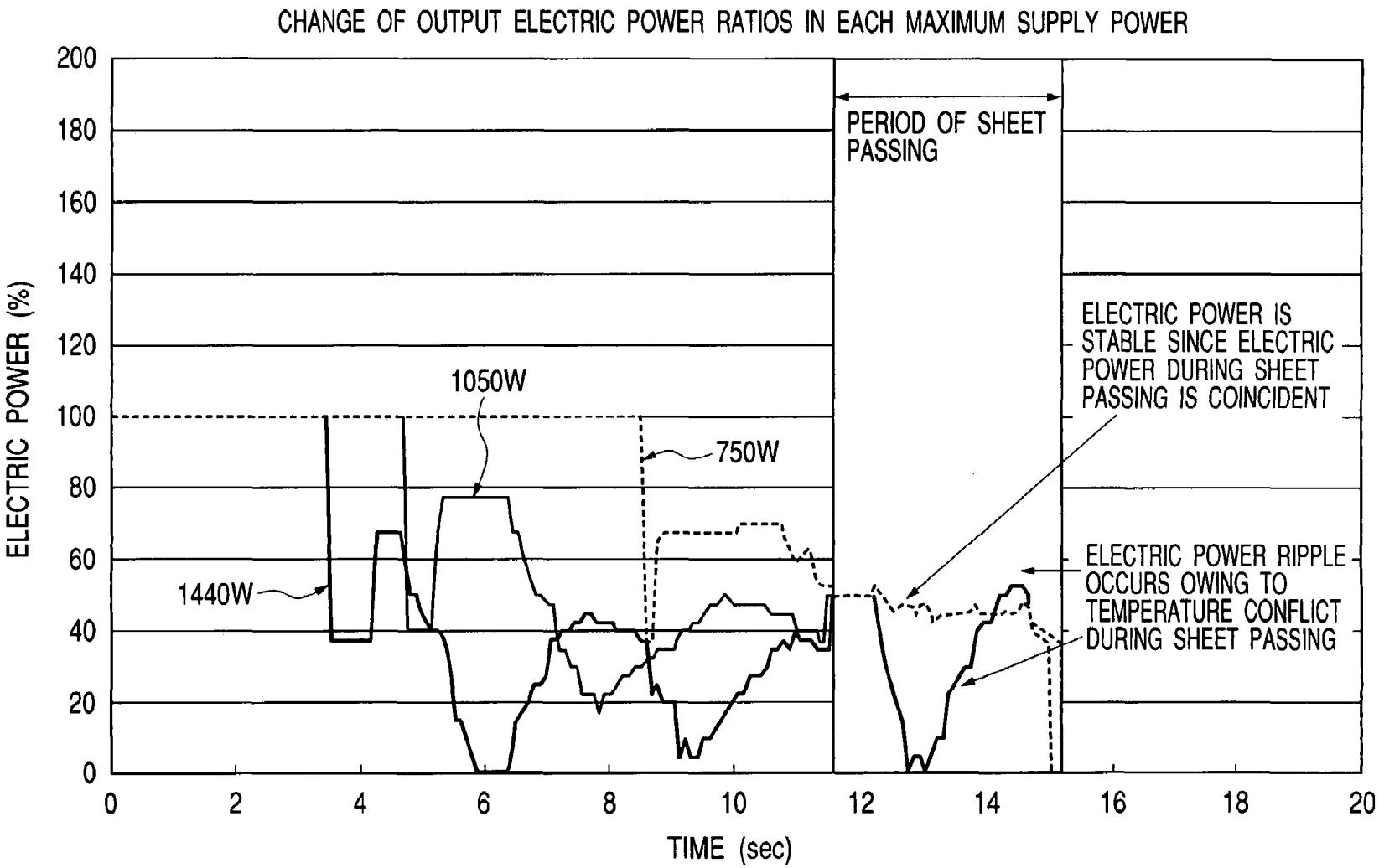
FIG. 9 is a graph showing a change in output electric power ratio at the time when start-up temperature control is executed using a conventional fixing apparatus.

As the comparative example, FIG. 9 shows supply power ratios to the fixing heater 16 at the time when a sheet of paper is printed after the start-up from the room temperature condition in the conventional fixing apparatus, where the maximum supply powers are respectively 750 W, 1,050 W and 1,440 W.

It can be understood from FIGS. 7 and 9 that in the event that constant control is executed over a wide range of the maximum supply power, very large overshoot appears when the maximum supply power is large (1,440 W) at the start-up time. Further, when the maximum supply powers are 750 W and 1,440 W, the predetermined power is not coincident with the necessary power value since the predetermined power is optimized at 1,050 W. Therefore, it can be understood that sheet passing is started without convergence of the power control, and the temperature is not stabilized. Further, even at the time of sheet passing, the predetermined power at the time of start of sheet passing is not coincident with the necessary power value similarly when the maximum supply powers are 750 W and 1,440 W, respectively. Therefore, it can be considered that the output power ratio during the sheet passing is largely disturbed, and hence the temperature of the fixing belt 20 is in disturbance.

Durability of the fixing member will be described.

If drives, in which the temperature detected by the sub thermistor 19 exceeds about 290° C. at the start-up time as in the conventional apparatus, are repeated, slip of the fixing belt 20 is likely to occur due to torque rise accompanying thermal degradation of the fixing apparatus. Accordingly, endurance life of the fixing members, such as the fixing belt 20 and the pressure roller 22, is likely to decrease.

The slip of the fixing belt 20 appears in the event that dynamic friction force between the fixing belt 20 and the constituent member, such as the fixing heater 16, in the fixing belt 20 exceeds the maximum static friction force between the fixing belt 20 and the pressure roller 22 or the recording material P. It is known that the dynamic friction force between the fixing belt 20 and the constituent member, such as the fixing heater 16, in the fixing belt 20 is greatly influenced especially by the condition of grease, and that the dynamic friction force increases when the grease moves to an unnecessary portion and its quantity decreases, and when the grease itself is degraded. The dynamic friction force increases as endurance of the fixing apparatus proceeds since the grease decreases in its quality, or is degraded. Especially, driving at excessively high temperatures causes great damage to the grease.

The dynamic friction force between the fixing belt 20 and the constituent member, such as the fixing heater 16, in the fixing belt 20 is the largest factor among loads on the driving unit at the time of driving the fixing apparatus. In other words, degree of slipping easiness of the fixing belt 20 can be predicted by measuring the driving torque of the fixing apparatus.

It is known that the driving torque in the initial state of the fixing apparatus is about 14.7 N·cm, and that the slip of the fixing belt 20 possibly occurs around the time when the driving torque exceeds about 14.7 N·cm.

When the conventional fixing apparatus is used, the driving torque subsequent to the endurance test is about 43.12 N·cm. In contrast, when the fixing apparatus of this embodiment is used, the driving torque is about 24.5 to 31.36 N·cm. Herein, the slip of the fixing belt 20 occurs in the conventional fixing apparatus, while no malfunction appears in the fixing apparatus of this embodiment.

Thus, almost no overshoot of the surface temperature of the fixing belt 20 appears at the start-up time, so that endurance life can be greatly prolonged without imposition of driving at excessively high temperatures on the apparatus.

Here, the slip of the fixing belt 20 is exemplified as a typical example causing short endurance life. This embodiment is, however, naturally effective to prolong life of each member in the fixing apparatus by preventing the overshoot in the event that the overshoot of the fixing apparatus is large, since excessive load is imposed on each member in the fixing apparatus in this event.

The corrected power used here is not necessarily strictly equal to the necessary predetermined power. They need only to be approximately equal to each other. The reason therefor is that after supply of the predetermined power for a predetermined time of period, the PID control is recovered such that the temperature of the fixing belt 20 can be again controlled to approach the target temperature. In other words, where the corrected power is not strictly equal to the necessary predetermined power, the temperature of the fixing belt 20 once goes away from the target temperature, but thereafter is again controlled so as to approach the target temperature. Fluctuation in the temperature at this time is allowable if it is within a desired temperature ripple. Further, it is confirmed in the experiment that the present invention is effectively applicable in several cases where the standard power is 1,050 W, and the maximum supply power is in a range from 750 W to 1,440 W, but an applicable range of the maximum supply power can be wider than that range in principle.

(8) Conclusion

In this embodiment, the value of the maximum supply power to the fixing heater 16 is predicted based on the rise time of the temperature detected by the sub thermistor 19 from the temperature at the start of power supply to the fixing heater 16, and the output power is corrected according to the maximum supply power value at the time of output of the necessary power value needed for stabilization of the operation of the fixing apparatus, as discussed above. Thereby, overshoot/undershoot can be prevented irrespective of variations in the input voltage and the resistance value of the fixing heater 16, and the temperature can be stably controlled even at the start-up time and at the time of start of sheet passing.

(Second Embodiment)

In this embodiment, the following method will be described. In this method, the value of the maximum supply power to the fixing heater 16 is predicted based on the rise time of the temperature detected by the main thermistor 18 from the temperature at the start of power supply to the fixing heater 16, and the output power is corrected according to the maximum supply power value at the time of output of the necessary power value needed for stabilization of the operation of the fixing apparatus, as discussed above. Thereby, overshoot/undershoot can be prevented irrespective of variations in the input voltage and the resistance value of the fixing heater 16, and the temperature can be stably controlled even at the start-up time and at the time of start of sheet passing.

General construction and control of the fixing apparatus of the second embodiment are approximately the same as those of the first embodiment. The second embodiment is, however, different from the first embodiment in that the maximum supply power to be input into the fixing apparatus is predicted by measuring the temperature rise of the fixing belt 20, which is an object to be heated, using the temperature detected by the main thermistor 18, and the output power is corrected at the time of output of the necessary power for stable operation of the fixing apparatus.

The structure of the image forming apparatus of this embodiment is the same as that of the first embodiment as illustrated in FIG. 1. Further, the construction of the fixing apparatus is similar to that of the first embodiment as illustrated in FIGS. 2, 3, and 4A to 4C. Description of common portions will therefore be omitted.

In this embodiment, the prediction method of the maximum supply power to be input into the fixing apparatus is as follows. The maximum supply power is predicted by measuring the temperature rise of the fixing belt 20 of the heated object using the temperature detected by the main thermistor 18. Specifically, time T (msec) required for the temperature detected by the main thermistor 18 to rise from 90° C. to 130° C. is measured, and the prediction maximum supply power E (W) is calculated by the following formula (3)

$$E=3{,}500-2.7\times T+0.00067\times T^2 \quad (3)$$

Figure 10:
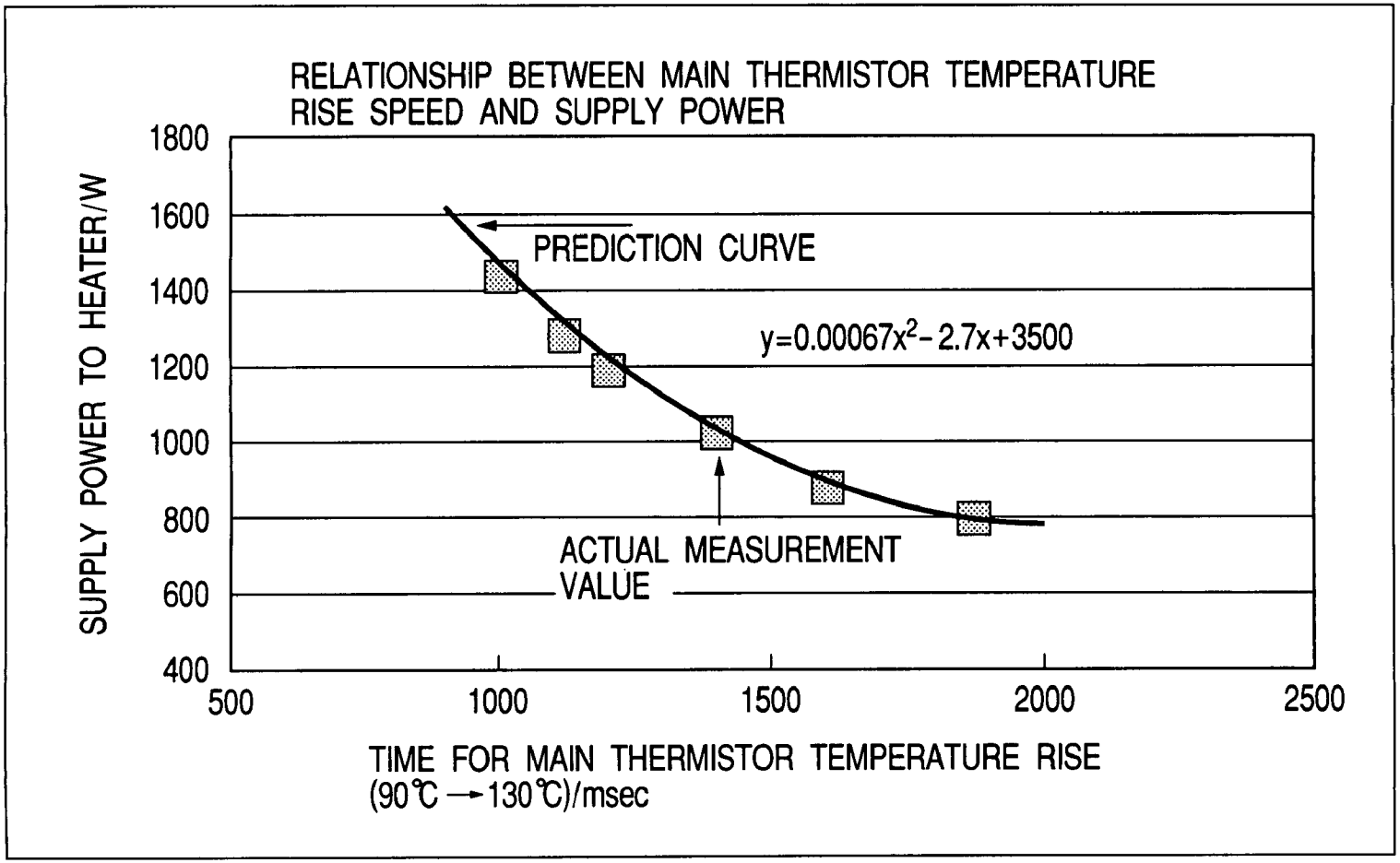
FIG. 10 is a graph showing the relationship between rise speed of temperature of a main thermistor and supply of electric power at the time when a fixing apparatus in a second embodiment according to the present invention is used.

FIG. 10 shows the comparison result between the prediction formula and the actual measured value. As shown in FIG. 10, the actual measurement value and the prediction formula well coincide with each other. It can be thus understood that a precise maximum supply power is obtained in this embodiment.

The prediction formula used here is what is optimized in a fixing apparatus as has the same construction as this embodiment, and accordingly this formula should be appropriately changed according to the structure and various conditions of an apparatus to which the present invention is applied. Naturally, the formula is changed according to the temperature range for measuring time of the start-up rise curve.

In other words, as the relationship between the time of the start-up rise curve and the supply power, the following formula is used, $$E=\alpha+\beta\times T+\lambda\times T^2 \quad (2).$$

And, in the fixing apparatus as has the same construction as this embodiment, when the relationship between the supply power and the temperature rise time necessary for the temperature detected by the main thermistor 18 to rise from 90° C. to 130° C. is to be shown, the prediction formula as written by the formula (3) is used since a formula with such coefficients as shown in the formula (3) well represents such relationship. Simple coefficients are used therein to reduce load to the control circuit portion (CPU) 21. It is not always necessary to use a second order polynomial as the prediction formula. It is possible to omit the second order term, use a higher order term, or use a formula of a different representation, depending on the construction of the fixing apparatus.

In the above-discussed fixing apparatus of the second embodiment, the maximum supply power is predicted using the temperature detected by the main thermistor 18, and the temperature rise of the fixing belt 20 heated by the fixing heater 16 is likely to be somewhat influenced by conditions of the fixing heater 16 and the nip portion of the fixing belt 20, as compared with the case where the temperature detected by the sub thermistor 19 for detecting the temperature rise of the fixing heater 16 is used. Accordingly, precision slightly decreases due to variations in the fixing apparatus, as compared with the case where the temperature rise of the fixing heater 16 is detected using the temperature detected by the sub thermistor 19. The second embodiment is, however, more advantageous in that there is no need to use the sub thermistor 19. That is, substantially the same effect can be achieved even in the fixing apparatus with the main thermistor only without using the sub thermistor.

In this embodiment, the prediction value is not updated when the temperature detected by the main thermistor 18 before the start-up temperature control is above 80° C., since the prediction value of the maximum supply power to be obtained by using the start-up temperature control cannot be calculated in the event that the temperature detected by the main thermistor 18 before the start-up temperature control exceeds the measurement range.

Figure 18:
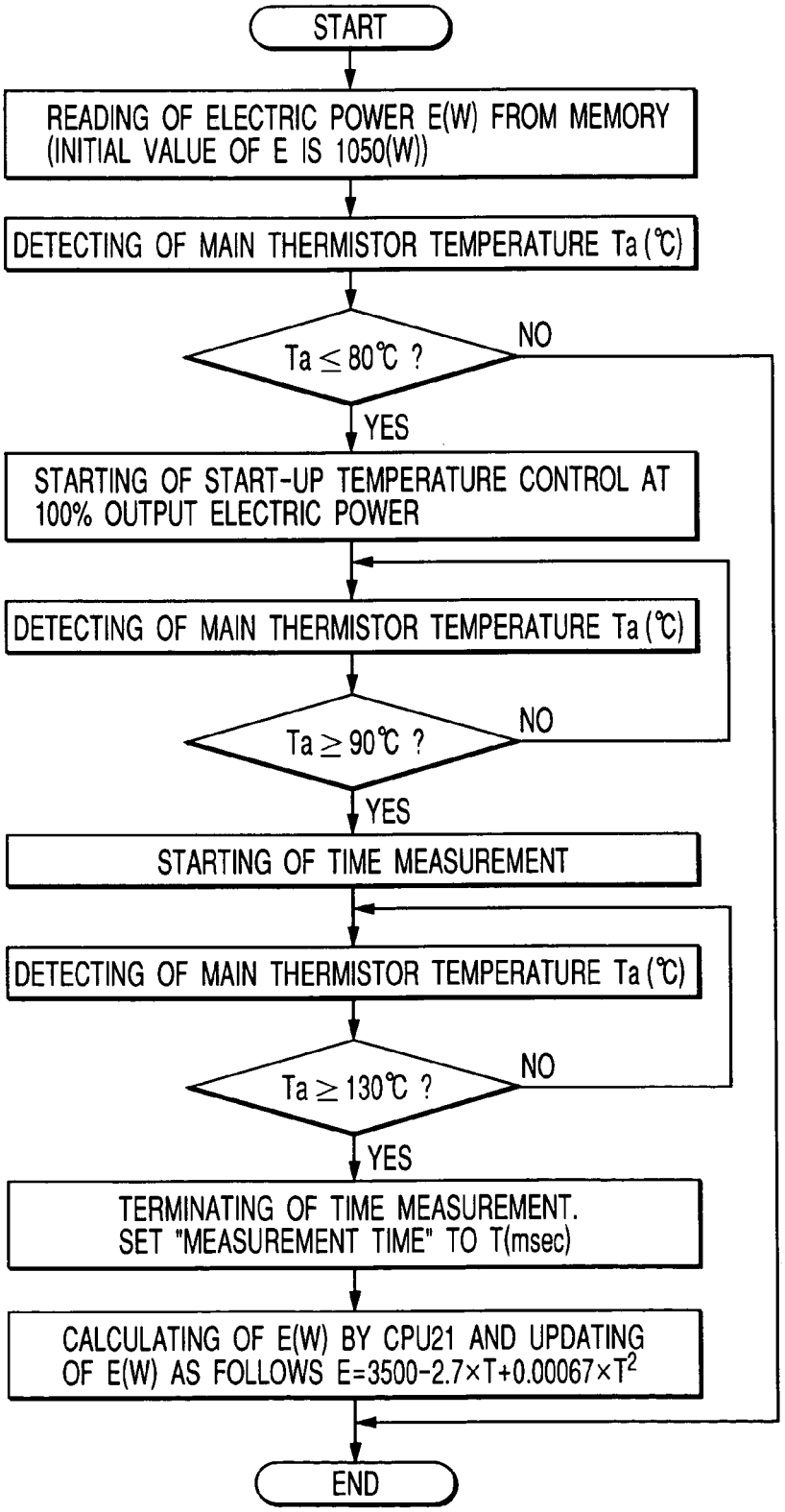
FIG. 18 is a flow chart showing a method of predicting the maximum supply power input into a fixing apparatus in a second embodiment according to the present invention.

FIG. 18 shows a flow chart of the prediction method of the maximum supply power to be input into the fixing apparatus of this embodiment. A precise maximum supply power can be obtained by using the temperature detected by the main thermistor in such a manner.

In this embodiment, as the temperature range for measuring time of the start-up rise curve, the detection temperature of the main thermistor 18 from 90° C. to 130° C. is used. This range is determined from the following conditions.

1) Lower Temperature Limit of the Temperature Range

The lower limit is an initial temperature of the main thermistor, and hence is at least above temperature of its use environment.

There exist influences of use temperature environment and heat storage condition of the fixing apparatus (correction is occasionally needed).

2) Upper Temperature Limit of the Temperature Range

The upper limit is the maximum driving temperature at the start-up time.

Since the measurement time of the rise curve increases as the upper limit is higher, reflection of power prediction is delayed in such a case.

From those standpoints of view, the detection temperature of the main thermistor 18 from 90° C. to 130° C. is most preferable as the temperature range for measuring time of the start-up rise curve, and this range is used in this embodiment. From the above conditions, it is preferable to use any range within a range from 70° C. to 150° C. as the temperature range of the rise curve, but it is not always necessary to use a range within this range.

Technical advantages of the second embodiment are the same as those of the first embodiment in principle, and the same effect can be obtained also in the second embodiment.

As described as above, in this embodiment, overshoot/undershoot can be prevented irrespective of variations in the input voltage and the resistance value of the fixing heater 16, and the temperature can be stably controlled even at the start-up time and at the time of start of sheet passing by the method in which the value of the maximum supply power to the fixing heater 16 is predicted based on the rise time of the temperature detected by the main thermistor 18 from the temperature at the start of power supply to the fixing heater 16, and the output power is corrected according to the maximum supply power value at the time of output of the necessary power needed for stabilization of the operation of the fixing apparatus.

(Third Embodiment)

In the third embodiment, the following method will be described. In this method, when the value of the maximum supply power to the fixing heater 16 is predicted based on the rise time of the temperature detected by the sub thermistor 19, or the main thermistor 18 from the temperature at the start of power supply to the fixing heater 16, updating of the measurement result is determined based on the heat storage condition of the fixing apparatus to reduce influences of the heat storage condition of the fixing apparatus. And, the output power is corrected according to the maximum supply power value at the time of output of the necessary power value needed for stabilization of the operation of the fixing apparatus, and the corrected value is stored in an EEPROM in a predetermined timing. Thereby, overshoot/undershoot can be prevented irrespective of OFF-ON of the power source, and variations in the input voltage and the resistance value of the fixing heater 16, and the temperature can be stably controlled even at the start-up time and at the time of start of sheet passing.

General construction and control of the fixing apparatus of the third embodiment are approximately the same as those of the first and second embodiments. The third embodiment is, however, different from the first and second embodiments in that the output power is corrected at the time of output of the necessary power for stable operation of the fixing apparatus, using the prediction value obtained considering the heat storage condition of the fixing apparatus, when the maximum supply power to be input into the fixing apparatus is predicted.

The structure of the image forming apparatus of this embodiment is the same as that of the first and second embodiments as illustrated in FIG. 1. Further, the construction of the fixing apparatus is similar to that of the first embodiment as illustrated in FIGS. 2, 3 and 4A to 4C. Description of common portions will therefore be omitted.

In this embodiment, time T (msec) required for the temperature detected by the sub thermistor 19 to rise from 150° C. to 210° C. is measured, and the prediction maximum supply power E (W) is calculated by the following formula. The prediction value is updated only when the temperature detected by the sub thermistor 19 immediately before the start-up is equal to or less than 140° C., and treatment is divided into the following two cases depending on the temperature detected by the sub thermistor 19.

$$E=0.00010\times T^2-0.74\times T+2{,}000 \text{ (up to 70° C.)} \quad (4)$$

$$E=0.00010\times T^2-0.78\times T+2{,}000 \text{ (70° C. to 140° C.)} \quad (5)$$

Figure 11:
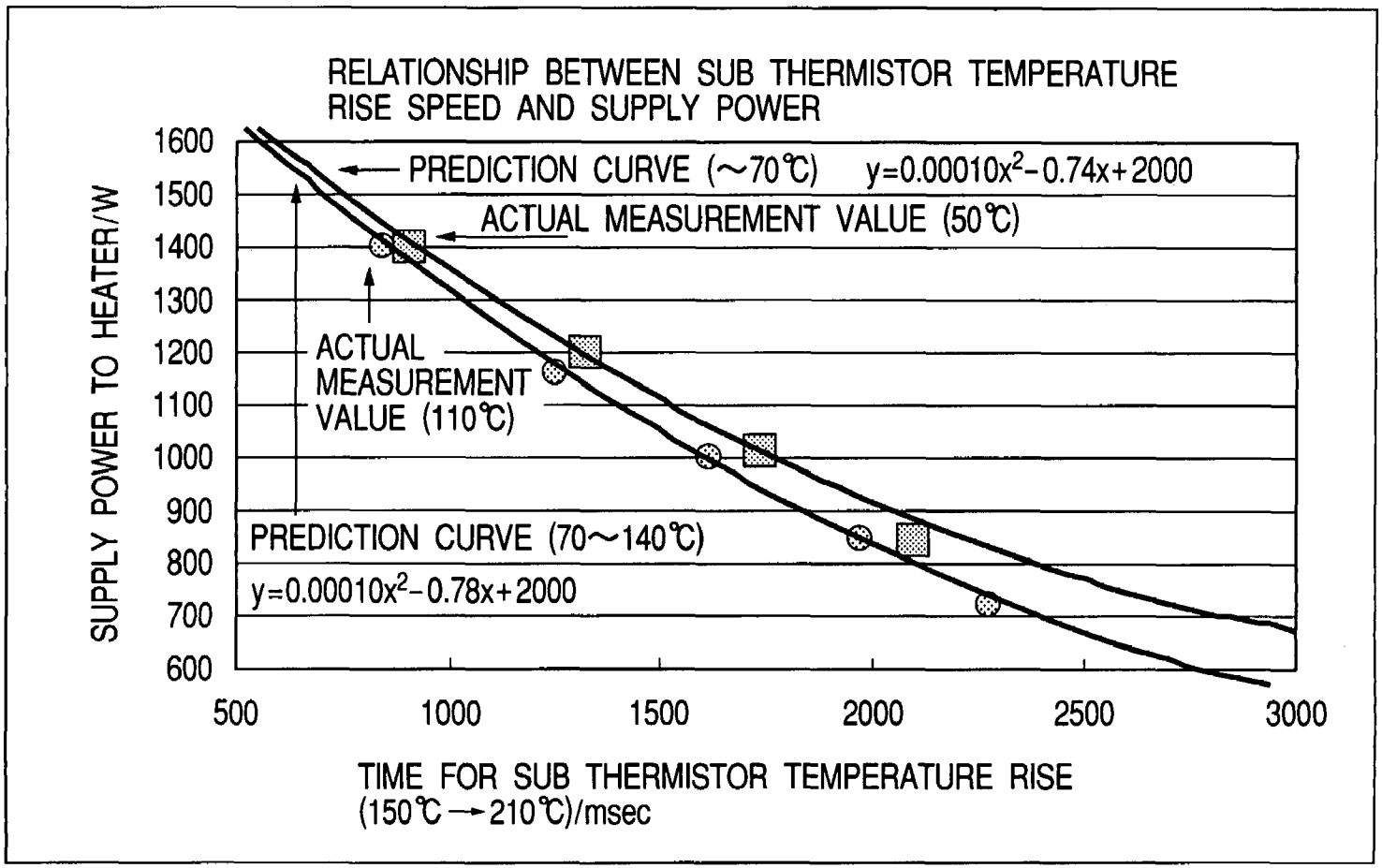
FIG. 11 is a graph showing the relationship between rise speed of temperature of a main thermistor and supply of electric power at the time when the present invention is applied to a fixing apparatus of an electromagnetic induction heating type.

FIG. 11 shows comparison results between the prediction formula in the case where the temperature detected by the sub thermistor 19 immediately before the start-up is less than 70° C., the prediction formula in the case where the temperature detected by the sub thermistor 19 immediately before the start-up is equal to or more than 70° C., and less than 140° C., measurement values for respective maximum supply powers in the case where the temperature detected by the sub thermistor 19 immediately before the start-up is 50° C., and measurement values for respective maximum supply powers in the case where the temperature detected by the sub thermistor 19 immediately before the start-up is 110° C. It can be understood therefrom that precision of the prediction value is further improved by the division into cases according to heat storage conditions of the fixing apparatus.

Figure 19:
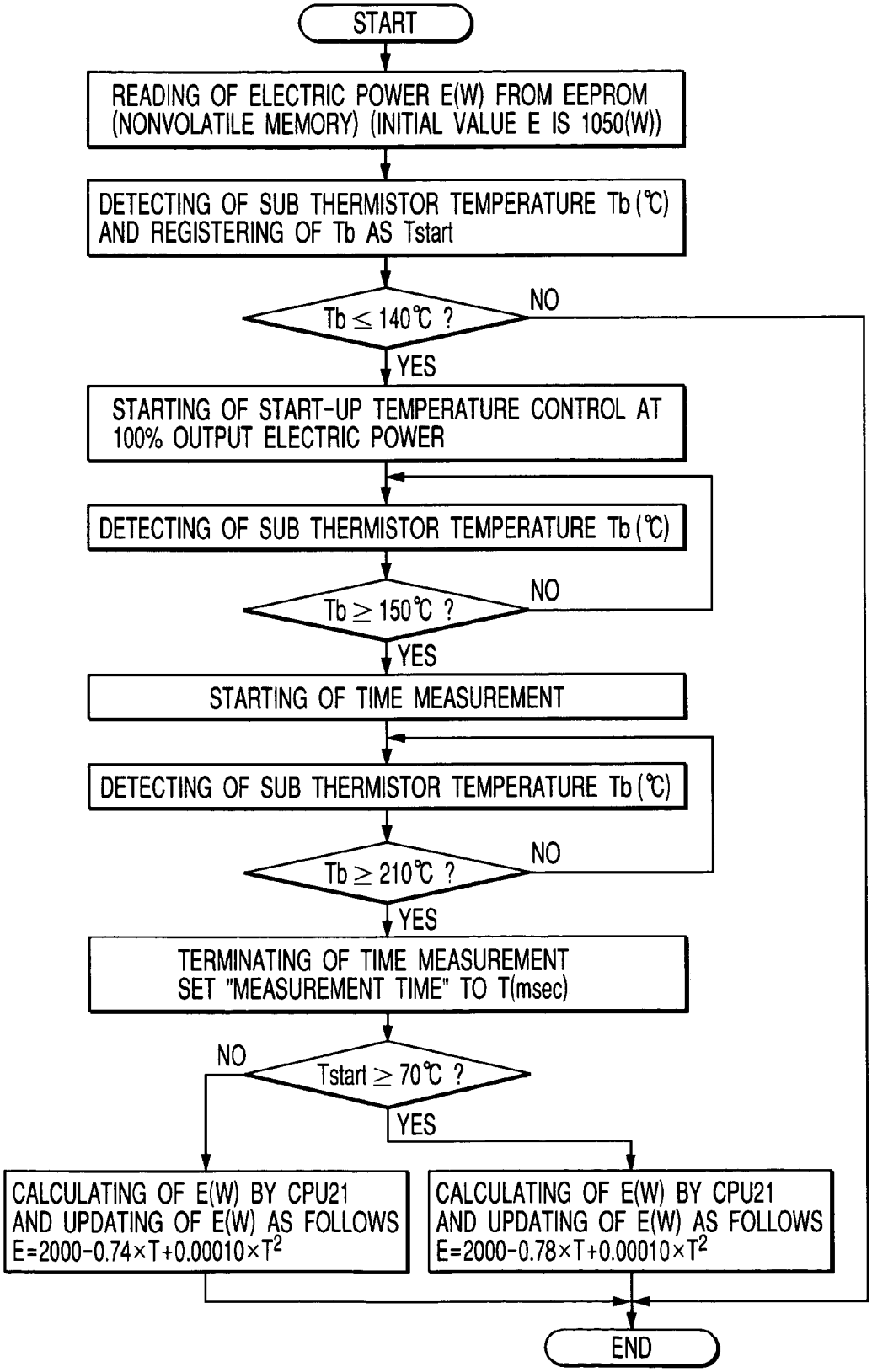
FIG. 19 is a flow chart showing a method of predicting the maximum supply power input into a fixing apparatus in a third embodiment according to the present invention.

FIG. 19 shows a flow chart of the prediction method of the maximum supply power to be input into the fixing apparatus of this embodiment. A precise maximum supply power can be obtained by using the temperature detected by the sub thermistor in such a manner.

Here, the temperature detected by the sub thermistor 19 immediately before the start-up is used, but the heat storage condition of the fixing apparatus can be considered by using other methods such as the main thermistor 18. Further, measurement of the temperature rise time by using the main thermistor, but not the sub thermistor can also be used.

Separately from such methods, it is further preferable that the correction is executed considering a voltage drop of the power source circuit, for example, to improve precision of the prediction value. It is, however, not always necessary to use this method, since the apparatus can be practically used if influence of the ripple due to the variation in power is small enough.

In this embodiment, the effect can be achieved by recording the corrected power in the EEPROM in a predetermined timing, even when OFF-ON of the power source is executed under the condition under which the fixing apparatus is sufficiently heated (the condition under which the prediction value is not updated). The recording timing into the EEPROM needs only to be determined considering the write-in life into the EEPROM, variation in the actual maximum supply power accompanying the variation in the power source in use, and influence of the update interval. In this embodiment, when the prediction value is updated three times, data once written in the EEPROM is updated.

Technical advantages of this embodiment are similar to those of the first and second embodiments in principle, and substantially the same effect can be obtained in the third embodiment. In this embodiment, the influence of the ripple due to an error in the prediction value of the maximum supply power can be further reduced, and the effect can be obtained even in the event that OFF-ON of the power source is performed, since precision of the prediction value is improved.

As described as above, in this embodiment, overshoot/undershoot can be prevented irrespective of OFF-ON of the power source, and variations in the input voltage and the resistance value of the fixing heater 16, and the temperature can be stably controlled even at the start-up time and at the time of start of sheet passing by the following method. In this method, when the value of the maximum supply power to the fixing heater 16 is predicted based on the rise time of the temperature detected by the sub thermistor 19, or the main thermistor 18 from the temperature at the start of power supply to the fixing heater 16, updating of the measurement value is determined based on the heat storage condition of the fixing apparatus to reduce influences of the heat storage condition of the fixing apparatus, the output power is corrected according to the maximum supply power value at the time of output of the necessary power value needed for stabilization of the operation of the fixing apparatus, and the corrected value is stored in the EEPROM in the predetermined timing.

(Fourth Embodiment)

The fourth embodiment is directed to a prediction method of predicting the maximum supply power applied to a fixing apparatus which is different from the fixing apparatuses of the first, second and third embodiments. The same effect as described above can be achieved also in the fourth embodiment.

Figure 13:
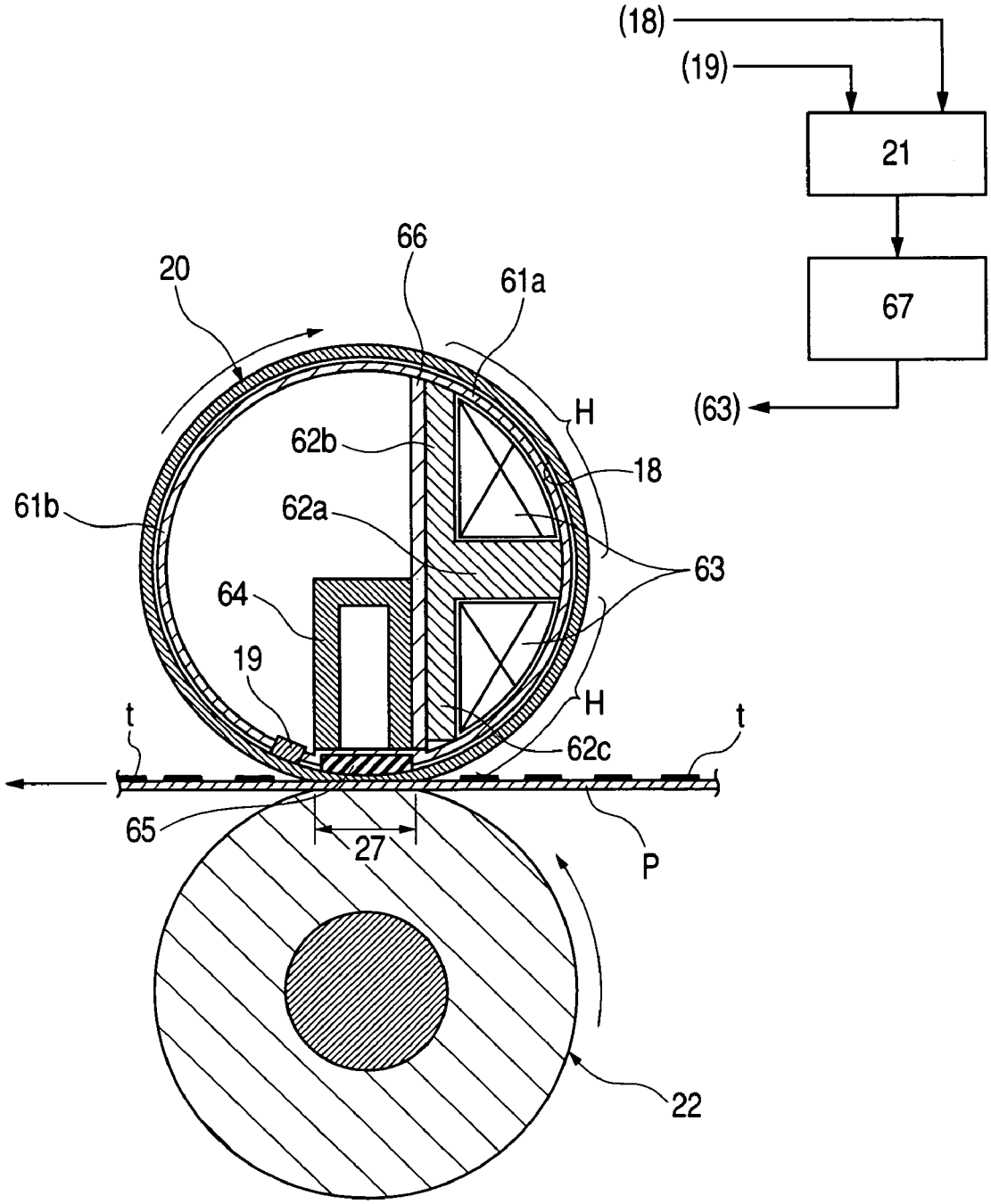
FIG. 13 is a cross-sectional view schematically illustrating a fixing apparatus of an electromagnetic induction heating type.
Figure 14:
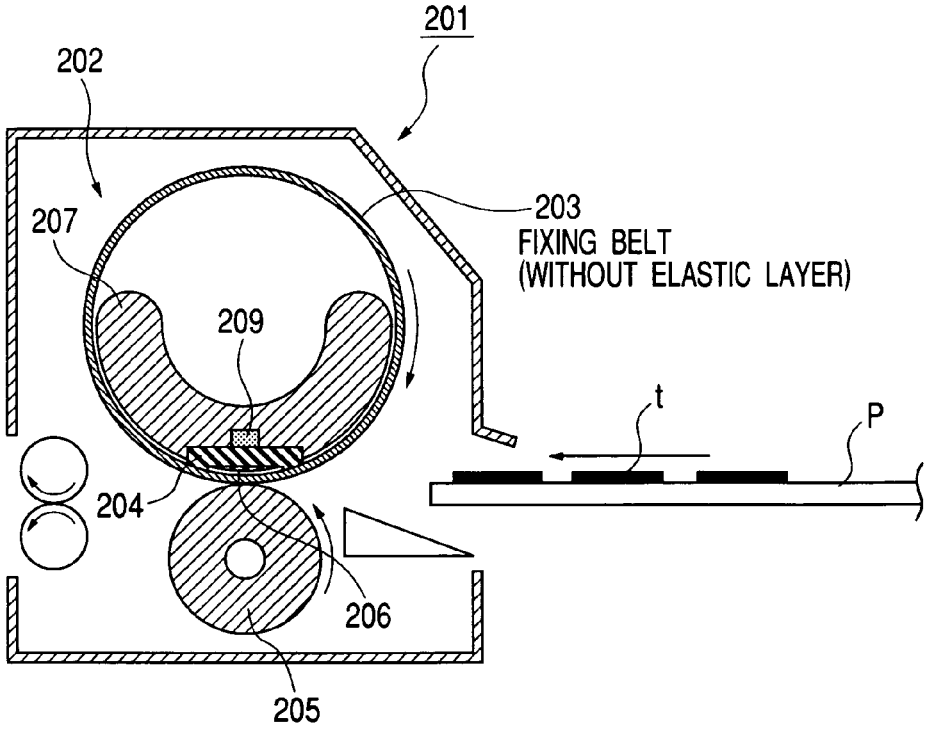
FIG. 14 is a cross-sectional view schematically illustrating a fixing apparatus of a conventional belt fixing type.
Figure 15:
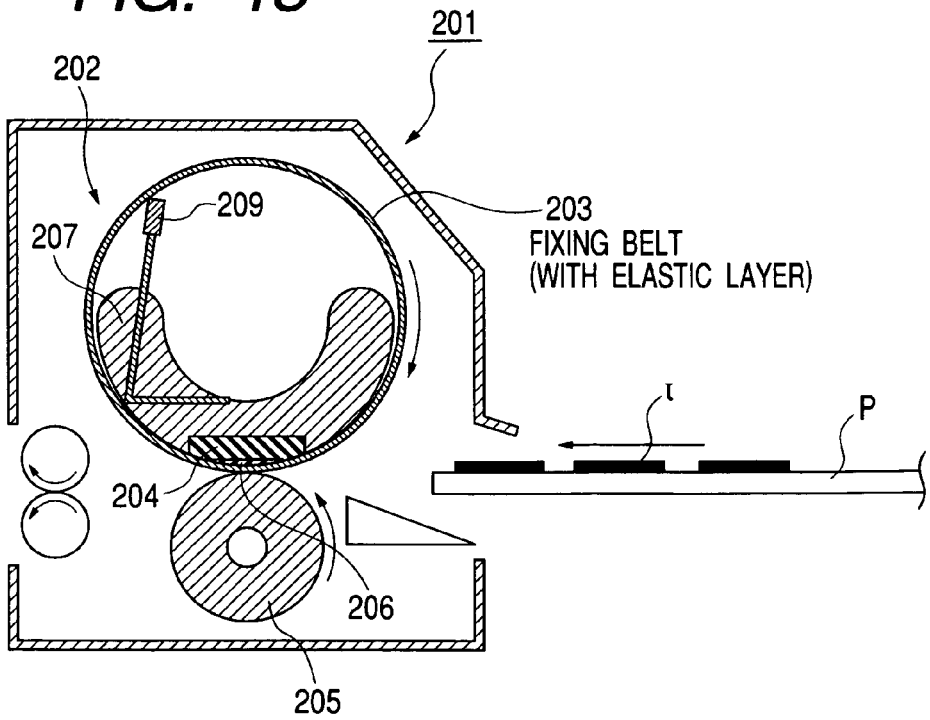
FIG. 15 is a cross-sectional view schematically illustrating a fixing apparatus using a thermistor of a fixing belt inner surface abutting type in a conventional belt fixing type.

A so-called electromagnetic induction heating fixing apparatus is used in this embodiment as the different fixing apparatus. FIG. 13 schematically illustrates the structure of the electromagnetic induction heating fixing apparatus.

A magnetic field generating unit includes a magnetic cores 62*a*, 62*b* and 62*c*, and a magnetic field exciting coil 63. The magnetic corea 62*a*, 62*b* and 62*c* are formed of material having high magnetic permeability. It is preferably a material usable for a core of a transformer, such as ferrite and permalloy, and more preferably ferrite whose loss is small even at 100 kHz.

Reference numeral 67 designates a high-frequency oscillating circuit unit serving as the power supply unit which is capable of generating high frequency power from 20 kHz to 500 kHz by its switching electric power source. The magnetic field exciting coil 63 generates alternating magnetic flux by alternating current (high-frequency current) supplied from the power supply unit 67.

Reference numerals 61*a* and 61*b* designate trough-shaped belt guide members each having an approximately semicircular arcuate cross section, which face each other on their open sides to form an approximately cylindrical body. A cylindrical electromagnetic induction heat-generating fixing belt 20 (a fixing sleeve, or a first rotatable member) is externally wound loosely around the outer circumference of the belt guide members. The belt guide member 61*a* holds the magnetic cores 62*a*, 62*b* and 62*c*, and the magnetic field exciting coil 63 on its inner side. A sliding member 65 is provided in the belt guide member 61*a* on an inner side of the fixing belt 20 and on a side of the nip portion 27 opposite to the pressure roller 22.

Reference numeral 64 designates an elongate rigid pressure stay disposed in contact with an inner plane portion of the belt guide member 61*b*. Reference numeral 66 designates an insulating member for insulating the magnetic cores 62*a*, 62*b* and 62*c*, and the magnetic field exciting coil 63 from the rigid pressure stay 64.

The rigid pressure stay 64 generates depression force by means of a pressure mechanism (not shown). Accordingly, the sliding member 65 provided on the lower surface of the belt guide member 61*a* is brought into pressure contact with the pressure roller 22 with the fixing belt 20 being sandwiched therebetween, and the fixing nip portion 27 with a predetermined width is thus constructed.

The pressure roller 22 is driven and rotated in a counterclockwise direction of an arrow by a driving unit (not shown). Due to the rotation of the pressure roller 22, friction force between outer surfaces of the pressure roller 22 and the fixing belt 20 occurs. The friction force causes rotational force acting on the fixing belt 20, and the fixing belt 20 is accordingly rotated in a clockwise direction of an arrow around the belt guide members 61*a* and 61*b* at a circumferential rate approximately corresponding to the rotational circumferential rate of the pressure roller 22 with the inner surface of the fixing belt 20 being in close contact with and slid on the lower surface of the sliding member 65 at the fixing nip 27. In this structure, lubricant, such as heat resisting grease, can be interposed between the lower surface of the sliding member 65 and the inner surface of the fixing belt 20 at the fixing nip portion 27 to reduce mutual sliding friction force therebetween.

The alternating magnetic flux guided in the magnetic cores 62*a*, 62*b* and 62*c* generates eddy current in an electromagnetic induction heat-generating layer (not shown) serving as a heating member for the fixing belt 20 at locations between the magnetic core 62*a* and the magnetic core 62*b*, and between the magnetic core 62*a* and the magnetic core 62*b*. The eddy current generates Joule heat (eddy current loss) in the electromagnetic induction heat-generating layer due to specific resistance (electric resistivity) of the electromagnetic induction heat-generating layer in the fixing belt 20 described later. Here, a heat-generating area is defined by an area whose exothermic amount is above Q/e where Q is the maximum exothermic amount. In this area, the exothermic amount needed for fixation can be obtained.

In the electromagnetic induction heating fixing apparatus of this embodiment, the fixing belt 20 used here has a multi-layer structure including a heat-generating layer (not shown) formed of a metal belt or the like serving as a substrate layer of the electromagnetic induction heat-generating fixing belt 20, an elastic layer (not shown) layered on the outer surface of the heat-generating layer, and a separating layer (not shown) layered on the outer surface of the elastic layer. A primer (not shown) can be provided between respective layers to achieve bonding between the heat-generating layer and the elastic layer and between the elastic layer and the separating layer. In the approximately cylindrical fixing belt 20, the heat-generating is on its inner side, and the separating layer is on its outer side. As discussed above, when the alternating magnetic flux acts on the heat-generating layer, the eddy current appears in the heat-generating layer, and the heat-generating layer is heated. The heat is transmitted to the fixing nip portion 27 through the elastic layer and the separating layer, and the recording material P of a heated material passing through the fixing nip portion 27 is heated such that the toner image can be heated and fixed.

Temperature of the fixing belt 20 is controlled and maintained at a predetermined temperature by control of supply of current to the exciting coil 63 using temperature controlling systems 21 and 67 including the main and sub thermistors 18 and 19 of the temperature detecting unit. More specifically, the main thermistor 18 is the temperature detecting unit for detecting the temperature of the fixing belt 20, and the main thermistor 18 is disposed facing the outer surface of the belt guide member 61*a* in the heat-generating area H on the inner surface of the fixing belt 20 in this embodiment. The main thermistor 18 is in contact with the inner surface of the fixing belt 20 to detect the temperature of the fixing belt 20. Temperature information of the fixing belt 20 measured by the main thermistor 18 is input into the control circuit (CPU) 21. The control circuit (CPU) 21 controls current supply to the exciting coil 63 from the power supply unit 67 based on the input temperature information such that the temperature of the fixing belt 20, namely the temperature of the fixing nip portion 27, can be controlled and adjusted to the predetermined temperature.

Under a temperature control condition under which the fixing belt 20 is rotated, the electromagnetic induction heat generation is caused by the power supply to the exciting coil 63 from the power supply unit 67 as discussed above, and the fixing nip portion 27 is heated up to the predetermined temperature, the recording material P bearing unfixed toner images t conveyed from the image forming unit portion is guided into the fixing nip portion 27 between the fixing belt 20 and the pressure roller 22 with the image bearing surface facing the surface of the fixing belt upwardly. The image bearing surface of the recording material P is brought into close contact with the outer surface of the fixing belt 20 at the fixing nip portion 27, and the recording material P is nipped and conveyed through the fixing nip portion 27 simultaneously with the rotation of the fixing belt 20. During the nipped conveyance of the recording material P together with the fixing belt 20, the recording material P is heated by the electromagnetic induction heat generation of the fixing belt 20, and the unfixed toner image t on the recording material P is heated and fixed. Upon passing of the recording material P through the fixing nip portion 27, the recording material P is separated from the outer surface of the fixing belt 20, and discharged. The heated fixed toner image on the recording material is cooled to be a permanent fixed image after passing through the fixing nip portion.

Also in the fixing apparatus using the electromagnetic induction heating system, the rise temperature of the heated fixing belt 20 is similarly measured based on the temperature detected by the main thermistor 18 in contact with the fixing belt 20, and the maximum supply power to the magnetic field exciting coil 63 is accordingly predicted.

In the fixing apparatus of this embodiment, the relationship between time T (msec) required for the temperature detected by the main thermistor 18 to rise from 90° C. to 130° C. and the prediction maximum supply power E (W) cab be represented by the following formula $$E=1{,}900-0.62\times T+0.000086\times T^2 \quad (6)$$

Figure 12:
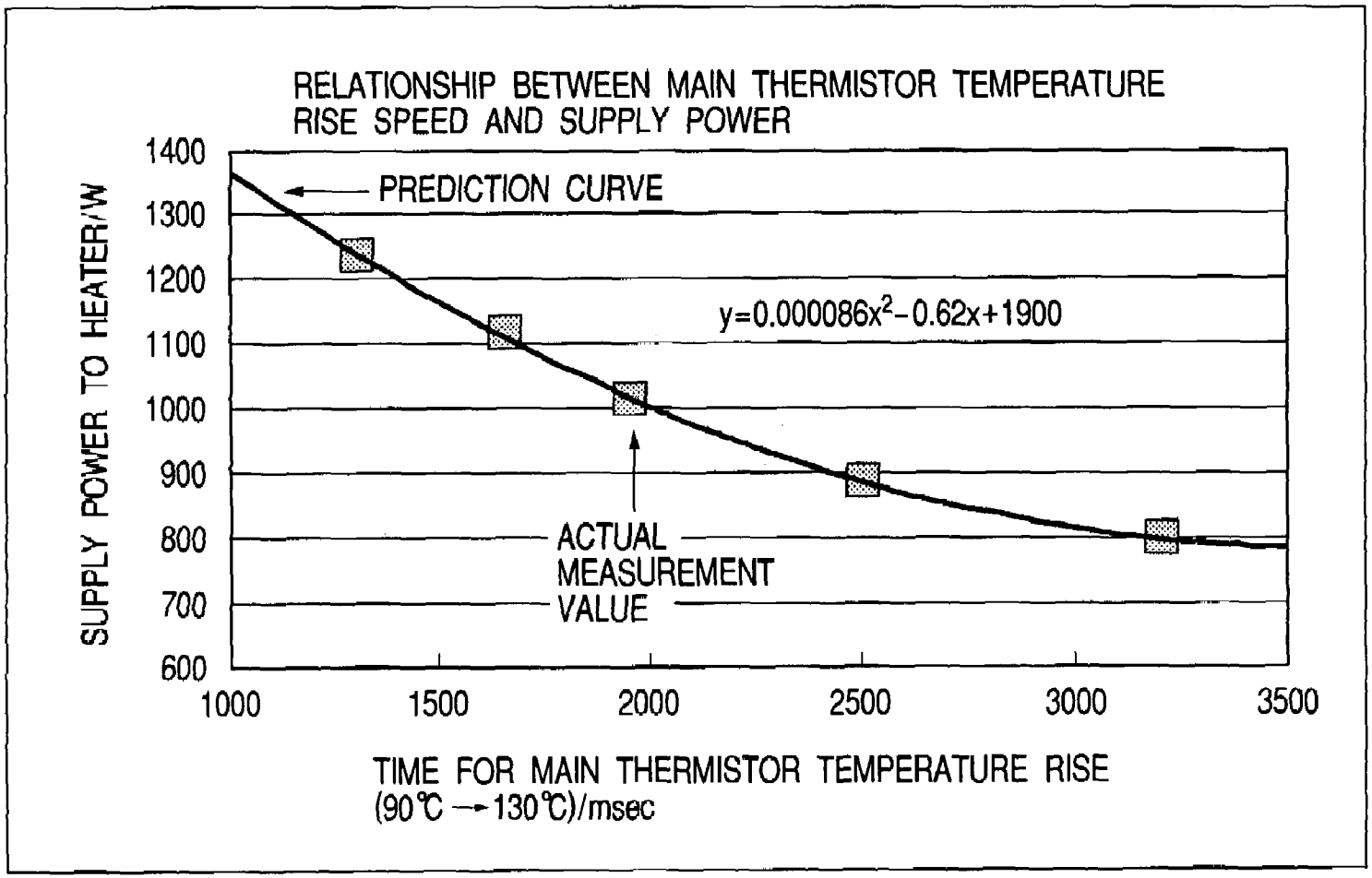
FIG. 12 is a graph showing the relationship between rise speed of temperature of a sub thermistor and supply of electric power at the time when a fixing apparatus in a third embodiment according to the present invention is used.

FIG. 12 shows the comparison result between the above prediction formula and the measurement value. As shown in FIG. 12, also in the fixing apparatus of this embodiment, the actual measurement value and the prediction formula (6) well coincide with each other. It can be thus understood that a precise maximum supply power can be obtained by this embodiment.

Figure 20:
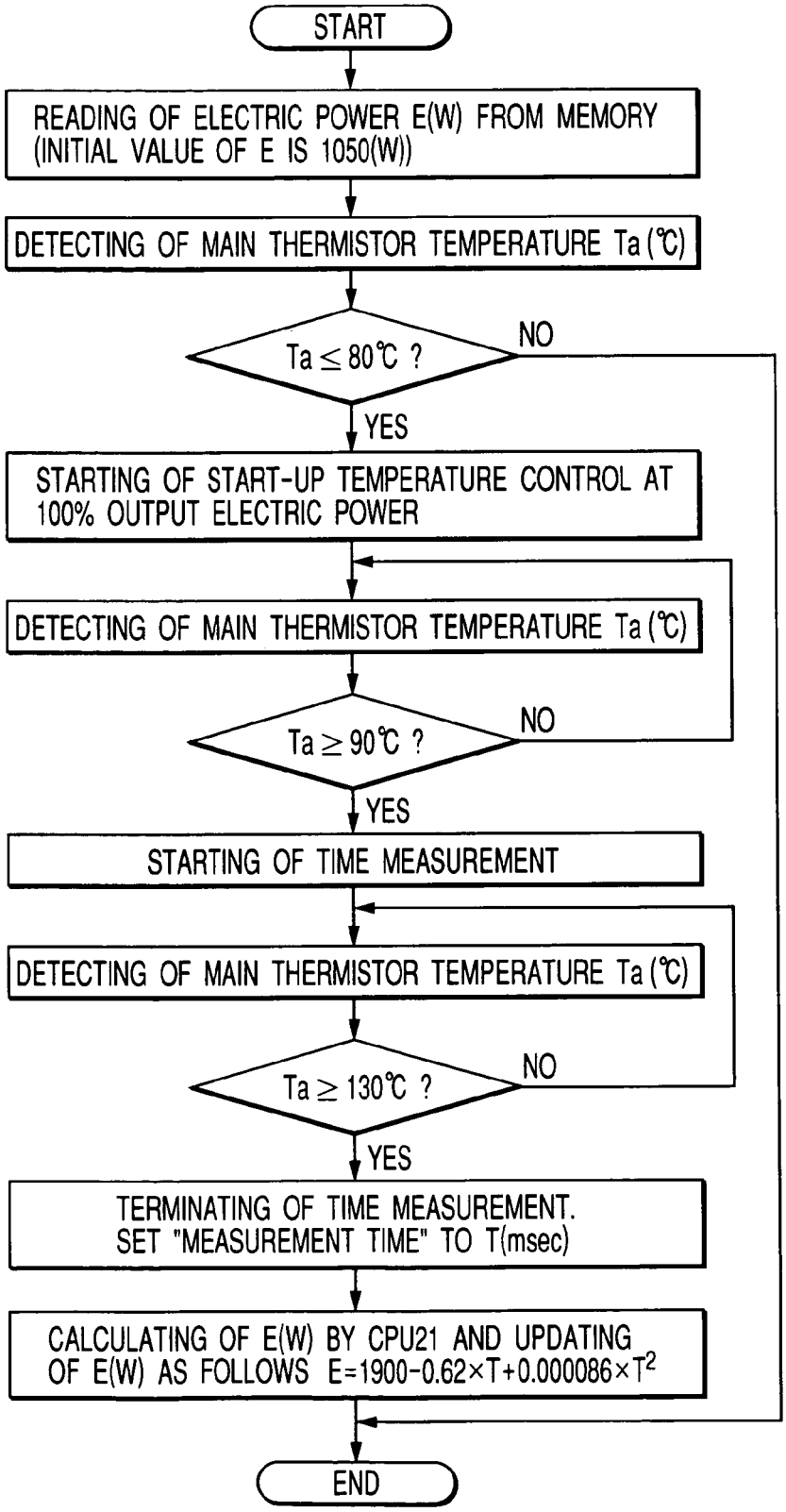
FIG. 20 is a flow chart showing a method of predicting the maximum supply power input into a fixing apparatus in a fourth embodiment according to the present invention.

FIG. 20 shows a flow chart in connection with the prediction method of the maximum supply power to be input into the fixing apparatus of this embodiment. When the temperature detected by the main thermistor 18 is used in such a manner, the maximum supply power can be precisely obtained. Also in this embodiment, similar to the second embodiment, the detection temperature of the main thermistor 18 from 90° C. to 130° C. is preferably used as the temperature range for measuring time of the start-up rise curve. It is preferable to use any range within a range from 70° C. to 150° C. as the temperature range of the rise curve, but it is not always necessary to use a range within this range.

The control power at the time of the temperature control can be thus corrected based on the prediction value of the maximum supply power to the exciting coil 63.

Also in the fixing apparatus using the different system, similar results can be obtained on a similar principle.

Also in this embodiment using the electromagnetic induction heating fixing apparatus which is different from the fixing apparatus used in the first, second and third embodiments, similar prediction method of the maximum supply power can be applied. That is, the value of the maximum supply power to the magnetic field exciting coil 63 is predicted, and the control power at the time of the temperature control can be corrected based on the prediction value, as discussed above. Thereby, overshoot/undershoot can be prevented irrespective of variations in the input voltage and the like, and the temperature can be stably controlled even at the start-up time and at the time of start of sheet passing.

(Others)

1) As described in the foregoing, in the above embodiments, the process speed is 87 mm/sec, the print speed is 16 sheets/min, the control temperature is 195° C., and the supply time of the predetermined power at the time of start of sheet passing is set to about 0.3 second to about 0.7 second (about 0.5 second) prior to the rush-in of the recording material. However, there can be cases where it is preferable to differently set the process speed, the print speed, and the control temperature depending on the kind of the recording material and desired quality of the image, or conditions under which more preferable fixing characteristic is desired. Also in those cases, it is possible to precisely control the temperature with small fluctuation in temperature, and obtain similar effects by application of the method of the present invention. Here, it is natural that the value of the corrected predetermined power and the supply time of the predetermined power are changed depending on the process speed, the print speed, and the control temperature. Further, it holds true for the timing for changing to the second power subsequent to the start-up, and the supply time of the second power.

2) Further, in the above embodiments, the maximum supply power is predicted from the measured temperature rise time using the prediction formula. This is what is used for reference to the maximum supply power using a simple control algorithm. Accordingly, prediction can be made by another method, such as a method which uses a table or the like of the experimentally-obtained relationship between the temperature rise time and the maximum supply power, and similar effects can be obtained in such a case.

3) Further, in the above embodiments, the maximum supply power is predicted from the temperature rise time measured by the main or sub thermistor. The reason therefor is that application of the present invention can be made possible also to an image forming apparatus by making use of its existing functions without adding complicate structure and control, at relatively low costs. Accordingly, the maximum supply power can be directly measured and corrected by newly providing a current detecting unit or a voltage detecting unit in the fixing apparatus. In this case, since time for measuring the maximum supply power is short, the maximum supply power can be instantaneously reflected to the power control advantageously. Power to be supplied to the fixing heater as current I (A) or voltage V (V) measured by the current detecting unit or voltage detecting unit can be written by $$E=I\times V=I^2\times R=V^2/R \quad (7)$$

When both the current detecting unit and the voltage detecting unit are provided, the predetermined power can be precisely corrected since the power can be accurately measured. Where one of them is provided, variation of the fixing heater 16 is about 7%, and this directly becomes an error at the time when the power value is calculated by formula (7). However, the power value can be calculated by measuring the resistance value of the fixing heater beforehand.

4) Further, in the above embodiments, the PID control is basically used as the power control for performing the temperature control. This is used as a control method in which the temperature is caused to rapidly approach the target temperature, and which is strongly resistant to external disturbance. Accordingly, the temperature control can also be performed by using P control, PI control, or other feedback controls, and similar effects can be obtained thereby.

5) Further, in the above embodiments, thermal capacity of the fixing belt 20 is at least above $4.2\times10^{-2}$ J/cm$^{2}$·° C., and below 4.2 J/cm$^{2}$·° C. The reason therefor is as follows. Where the thermal capacity of the fixing belt 20 is above $4.2\times10^{-2}$ J/cm$^{2}$·° C., precision of the temperature control is high since the temperature of a temperature detection portion of the main thermistor 18 is close to the temperature at the fixing nip location. Further, where the thermal capacity of the fixing belt 20 is below 4.2 J/cm$^{2}$·° C., power can be more effectively corrected in conformity with the rush-in timing of the recording medium P since response is fast. Accordingly, when the thermal capacity of the fixing belt 20 is above $4.2\times10^{-2}$ J/cm$^{2}$·° C., and below 4.2 J/cm$^{2}$·° C., outstandingly great effect can be obtained by application of the present invention. Therefore, the present invention can be applied even to the fixing apparatus with a fixing belt having thermal capacity outside the above range, and similar effects can be obtained also in such a case.

6) Further, in the above embodiments, the full power (100%) is supplied during the start-up temperature control, and the temperature rise speed is measured by detection using the main thermistor 18 or the sub thermistor 19 in the prediction method of the maximum supply power to be input into the fixing apparatus. Higher on-demand characteristic can be secured by using the full power. Therefore, the present invention can be applied even when the method, in which power supply of 75%, 50% or the like is conducted, and the temperature rise speed is measured by detection using the main thermistor 18 or the sub thermistor 19, is used, and similar effects can be obtained also in such a case.

7) Further, in the fourth embodiment, the temperature rise speed is detected by the main thermistor 18 in the heat-generating area H. Small decrease in precision due to variations of the fixing apparatus can be prevented thereby, as compared with the case where the temperature rise speed detected by, for example, the sub thermistor 19 disposed outside the heat-generating area H is used. Therefore, the maximum supply power can be predicted by measuring the temperature rise speed using the sub thermistor 19 disposed outside the heat-generating area H, and similar effects can be obtained also in such a case.

8) Further, the fixing apparatus with the fixing belt 20 having the elastic layer is described in the foregoing. Higher quality color image can be obtained thereby. Therefore, the present invention can be applied even to the fixing apparatus having a fixing belt without the elastic layer, such as a metal belt, and similar effects can be obtained t also in such a case.

9) Further, description is made to the fixing apparatus using as the heating member the ceramic heater made by forming the resistance heat-generating body on the ceramic substrate, and the fixing apparatus using the electromagnetic induction heating system. This heating member is used as a heating member for a relatively low-cost color on-demand fixing apparatus. The fixing apparatus can use a halogen lamp as the heating member, or an electromagnetic induction heating system different from the above system, and similar effects can be obtained also in such a case.

10) First and second fixing members for forming the fixing nip are not limited to the fixing belt and the pressure roller discussed in the above embodiments. The heating member (heat source) can be provided in each of the first and second fixing members.

11) The heating member is not necessarily located at the fixing nip portion 27. For example, the heat source can be provided at a location upstream of the fixing nip portion 21 in the fixing belt moving direction.

12) The fixing apparatus of the above embodiment adopts the pressure rotatable member driving system, but the fixing apparatus can use a system in which the driving roller is provided on the inner circumferential surface of the endless fixing belt, and the fixing belt is driven while tension is applied thereto.

13) The fixing apparatus of the present invention includes not only the fixing apparatus in which the unfixed image is heated and fixed on the recording material as the permanent image, but also an image heating apparatus in which the unfixed image is temporarily fixed on the recording material, an image heating apparatus in which image surface characteristics, such as gloss, are improved by re-heating the recording material bearing the image, and the like.

14) The image forming system of the image forming apparatus includes not only the electrophotographic system, but also an electrostatic recording system, a magnetic recording system, and the like, or a transferring system, and a direct system.

While the present invention has been described with reference to what are presently considered to be the preferred embodiments, it is to be understood that the invention is not limited to the disclosed embodiments. On the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A fixing apparatus comprising:

a first rotatable member having an endless configuration;

a second rotatable member in pressure contast with said first rotatable member, said second rotatable member causing a recording an image to be nipped and conveyed at a pressure contact portion between said first and second rotatable members;

temperature raising means for raising a temperature of a local portion of said first rotatable member by reception of a supply of electric power;

temperature detecting means for detecting a temperature of a location different from said pressure contact portion with respect to a rotational direction of said first rotatable member;

first control means for feedback-controlling electric power to be supplied to said temperature raising means based on the temperature detected by said temperature detecting means;

setting means for variably setting a set value corresponding to electric power to be supplied to said temperature raising means, based on a temperature rise speed detected by said temperature detecting means when a predetermined amount of electric power is supplied; and second control means for temporally supplying electric power corresponding to the set value set by said setting means to said temperature raising means in timing close to timing in which the temperature detected by said temperature detecting means reaches a target temperature, or timing close to timing in which the recording material rushes in said pressure contact portion when said fixing apparatus is started up, wherein time t of period for which said second control means is operated is represented by $t \leqq (a+L)/V$ where V is a moving speed of an outer circumference of said first rotatable member, a is a length of said first rotatable member from said pressure contact portion to said temperature detection location, and L is an outer circumferential length of said first rotatable member.

2. A fixing apparatus according to claim 1, wherein said temperature raising means includes a heater to be heated by supply of electric power, which is provided close to said pressure contact portion, or a coil for generating magnetic field due to supply of electric power and causing eddy curent to occur in said first rotatable member, which is provided close to said pressure contact portion.

3. A fixing apparatus according to claim 1, further comprising a nonvolatile memory for strong a value corresponding to the temperature rise speed detected by said temperature detecting means when the predetermined amount of electric power is supplied, and the set value set by said setting means.

4. An image forming apparatus in which an image is formed on a recording material, and the image on the recording material is fixed using said fixing apparatus recited in claim 1.

5. A fixing apparatus according to claim 1, further comprising condition judging means for judging a heat storage condition of said fixing apparatus, and wherein said setting means variably sets the set value corresponding to electric power to be supplied to said temperature raising means, based on a judgment result obtained by said condition judging means, and the temperature rise speed detected by said temperature detecting means when the predetermined amount of electric power is supplied.

6. A fixing apparatus according to claim 1, further comprising recording material kind judging means for judging the kind of the recording material, and wherein said setting means variably sets the set value corresponding to electric power to be supplied to said temperature raising means, based on a judgment result obtained by said recording material kind judging means, and the temperature rise speed detected by said temperature detecting means when the predetermined amount of electric power is supplied.

7. A fixing apparatus comprising:

a first rotatable member having an endless configuration;

a second rotatable member in pressure contact with said rotatable member said second rotatable member for causing a recording material bearing an image to be nipped and conveyed at a pressure contact portion between said first and second rotatable members;

temperature raising means for raising temperature of a local portion of said first rotatable member by reception of supply of electric power;

first temperature detecting means for detecting a temperature of a location different from said pressure contact portion with respect to a rotational direction of said first rotatable member;

second temperature detecting means provided near said pressure contact portion;

first control means for feedback-controlling to be supplied to said temperature raising means based on the temperature detected by said first temperature detecting means;

setting means for variably setting a set value corresponding to electric power to be supplied to said temperature raising means, based on a temperature rise speed detected by said second temperature detecting means when a predetermined amount of electric power is supplied; and second control means for temporally supplying electric power corresponding to the set value set by said setting means to said temperature raising means in timing close to timing in which the temperature detected by said temperature detecting means reaches a target temperature, or timing close to timing in which the recording material rushes in said pressure contact portion when said fixing apparatus is started up, wherein time t of period for which said second control means is operated is represented by $t \leqq (a+L)/V$ where V is a moving speed of an outer circumference of said first rotatable member, a is a length of said first rotatable member from said pressure contact portion to said temperature detection location, and L is an outer circumferential length of said first rotatable member.

8. A fixing apparatus according to claim 7, wherein said temperature raising means includes a heater to be heated by supply of electric power, which is provided close to said pressure contact portion, or a coil for generating magnetic field due to supply of electric power and causing eddy current to occur in said first rotatable member, which is provided close to said pressure contact portion.

9. A fixing apparatus according to claim 7, further comprising a nonvolatile memory for storing the set value set by said setting means.

10. An image forming apparatus in which an image is formed on a recording material, and the image on the recording material is fixed using said fixing apparatus recited in claim 7.

11. A fixing apparatus according to claim 7, further comprising condition judging means for judging a heat storage condition of said fixing apparatus, and wherein said setting means variably sets the set value corresponding to electric power to be supplied to said temperature raising means, based on a judgment result obtained by said condition judging means, and the temperature rise speed detected by said temperature detecting means when the predetermined amount of electric power is supplied.

12. A fixing apparatus according to claim 7, further comprising a recording material kind judging means for judging the kind of the recording material, and wherein said setting means variably sets the set value corresponding to electric power to be supplied to said temperature raising means, based on a judgment result obtained by said recording material kind judging means, and the temperature rise speed detected by said temperature detecting means when the predetermined amount of electric power is supplied.

* * * * *

UNITED STATES PATENT AND TRADEMARK OFFICE

CERTIFICATE OF CORRECTION

PATENT NO. : 7,013,097 B2
APPLICATION NO. : 10/720215
DATED : March 14, 2006
INVENTOR(S) : Tomoo Akizuki et al.

It is certified that error appears in the above-identified patent and that said Letters Patent is hereby corrected as shown below:

COLUMN 11:
Line 28, "and:" should read --and--.

COLUMN 13:
Line 7, "no" should read --not--.

COLUMN 14:
Line 58, "melt" should read --melted--.

COLUMN 24:
Line 1, "ruches" should read --rushes--.

COLUMN 29:
Line 46, "well coincide" should read --coincide well--.

COLUMN 33:
Line 15, "a" should be deleted.
Line 17, "corea" should read --cores--.

COLUMN 34:
Line 32, "heat-generating" should read --heat-generating layer--.

COLUMN 35:
Line 30, "cab" should read --can--.
Line 36, "well coincide" should read --coincide well--.

COLUMN 38:
Line 35, "contast" should read --contact--.
Line 37, "recording" should read --recording material bearing--.

UNITED STATES PATENT AND TRADEMARK OFFICE

CERTIFICATE OF CORRECTION

PATENT NO. : 7,013,097 B2
APPLICATION NO. : 10/720215
DATED : March 14, 2006
INVENTOR(S) : Tomoo Akizuki et al.

It is certified that error appears in the above-identified patent and that said Letters Patent is hereby corrected as shown below:

COLUMN 39:
Line 9, "curent" should read --current--.
Line 13, "strong" should read --storing--.
Line 42, "said" should read --said first--.
Line 43, "member" (1st occurrence) should read --member,--.
Line 56, "feedback-controlling" should read --feedback-controlling electric power--.

Signed and Sealed this

Twenty-sixth Day of September, 2006

JON W. DUDAS
*Director of the United States Patent and Trademark Office*